US011090543B2

(12) United States Patent
Meyer et al.

(10) Patent No.: US 11,090,543 B2
(45) Date of Patent: Aug. 17, 2021

(54) DECOUPLING HUB ASSEMBLY AND A BICYCLE TRAINER WITH A DECOUPLING HUB ASSEMBLY

(71) Applicant: SRAM, LLC, Chicago, IL (US)

(72) Inventors: James Meyer, Spearfish, SD (US); Christopher Shipman, Chicago, IL (US); Kevin Wesling, Lombard, IL (US)

(73) Assignee: SRAM, LLC, Chicago, IL (US)

( * ) Notice: Subject to any disclaimer, the term of this patent is extended or adjusted under 35 U.S.C. 154(b) by 0 days.

(21) Appl. No.: 16/219,032

(22) Filed: Dec. 13, 2018

(65) Prior Publication Data

US 2020/0188757 A1 Jun. 18, 2020

(51) Int. Cl.

| | |
|---|---|
| ***A63B 69/16*** | (2006.01) |
| ***A63B 21/22*** | (2006.01) |
| ***A63B 21/00*** | (2006.01) |

(52) U.S. Cl.

CPC ..... *A63B 69/16* (2013.01); *A63B 21/00069* (2013.01); *A63B 21/225* (2013.01); *A63B 2069/165* (2013.01)

(58) Field of Classification Search

CPC . A63B 69/16; A63B 21/225; A63B 21/00069; A63B 2069/165

See application file for complete search history.

(56) References Cited

U.S. PATENT DOCUMENTS

| | | | | |
|---|---|---|---|---|
| 4,082,265 | A * | 4/1978 | Berkes | A63B 22/16 280/293 |
| 4,441,705 | A * | 4/1984 | Brown | A63B 24/00 482/59 |
| 4,898,379 | A * | 2/1990 | Shiba | A63B 21/0051 482/61 |
| 4,976,424 | A * | 12/1990 | Sargeant | A63B 21/0053 482/3 |
| 5,042,795 | A * | 8/1991 | Bursik | A63B 69/16 482/61 |
| 5,397,285 | A * | 3/1995 | Haan | A63B 21/015 482/110 |
| 5,433,681 | A * | 7/1995 | Minoura | A63B 21/0051 482/61 |
| 5,480,366 | A | 1/1996 | Harnden et al. | |
| 5,656,001 | A * | 8/1997 | Baatz | A63B 69/16 482/61 |
| 6,620,081 | B2 * | 9/2003 | Phillips | A63B 21/015 482/57 |

(Continued)

FOREIGN PATENT DOCUMENTS

| | | |
|---|---|---|
| CN | 103239834 | 8/2013 |
| CN | 206604073 | 11/2017 |

(Continued)

*Primary Examiner* — Garrett K Atkinson

(57) ABSTRACT

A bicycle trainer has a stand, a resistance generating mechanism carried by the stand, and a decoupling hub assembly carried on the stand. The decoupling hub assembly has a torque coupler operably connected to the resistance generating mechanism. The torque coupler has a coupling portion configured to engage a coupling part of a drive body assembly on a bicycle. The coupling portion is exposed to an exterior of the stand engages the drive body assembly, which is rotationally driven by the drive train of the bicycle.

19 Claims, 16 Drawing Sheets

(56) References Cited

U.S. PATENT DOCUMENTS 6,736,761 B2 * 5/2004 Huang ..... A63B 21/0051 482/57
6,857,992 B1 * 2/2005 Kolda ..... A63B 21/0051 482/61
7,419,458 B2 * 9/2008 Forcillo ..... A63B 21/015 482/119
7,442,152 B2 * 10/2008 Peterson ..... A63B 69/16 482/57
7,470,220 B2 * 12/2008 Hernandez ..... A63B 21/012 188/25
7,976,434 B2 * 7/2011 Radow ..... A63B 21/00076 482/8
8,062,192 B1 * 11/2011 Arstein ..... A63B 21/015 482/57
8,845,493 B2 * 9/2014 Watterson ..... A63B 24/0087 482/4
9,421,417 B2 * 8/2016 Hsu ..... A63B 69/16
9,771,127 B2 * 9/2017 Braedt ..... B62M 9/10
9,855,480 B2 * 1/2018 Kalogiros ..... A63B 21/0058
9,919,182 B2 * 3/2018 Golesh ..... A63B 21/00069
10,046,222 B2 * 8/2018 Hawkins ..... A63B 69/16
10,576,348 B1 * 3/2020 Hawkins, III ..... A63B 24/0087
2003/0027692 A1 * 2/2003 Phillips ..... A63B 69/16 482/57
2006/0234839 A1 * 10/2006 Peterson ..... A63B 69/16 482/61
2008/0234112 A1 * 9/2008 Hernandez ..... A63B 21/00069 482/63
2009/0029832 A1 * 1/2009 Sartore ..... A63B 21/0051 482/63
2010/0018936 A1 1/2010 Donato
2011/0118086 A1 * 5/2011 Radow ..... A63B 24/0062 482/5
2011/0172059 A1 * 7/2011 Watterson ..... A63B 24/0062 482/5
2011/0281693 A1 * 11/2011 Arstein ..... A63B 21/00192 482/57
2011/0287902 A1 11/2011 Bingham, Jr. et al.
2012/0178592 A1 * 7/2012 Chieh ..... A63B 21/0054 482/57
2013/0237387 A1 * 9/2013 Bass ..... A63B 69/16 482/61
2014/0094349 A1 * 4/2014 Bass ..... A63B 21/00076 482/64
2014/0171266 A1 * 6/2014 Hawkins ..... A63B 21/00069 482/5
2016/0101313 A1 * 4/2016 Hsu ..... A63B 21/0088 482/61
2016/0236055 A1 * 8/2016 Kalogiros ..... A63B 21/00178
2017/0319906 A1 * 11/2017 Chang ..... G01L 3/22
2017/0368409 A1 * 12/2017 Felker ..... B62K 21/125
2018/0207468 A1 * 7/2018 Golesh ..... A63B 21/00072
2018/0369675 A1 * 12/2018 Papadopoulos ..... A63B 69/16
2019/0308064 A1 * 10/2019 Anderson ..... A63B 22/0605
2020/0122011 A1 * 4/2020 Papadopoulos ..... A63B 69/16

FOREIGN PATENT DOCUMENTS

CN 206924320 1/2018
ES 2445834 3/2014
TW 574047 2/2004
TW M424964 3/2012
TW 201332612 8/2013
TW 201808677 3/2018
TW I667153 8/2019
WO 2010018936 2/2010
WO 2010021461 2/2010

* cited by examiner

DECOUPLING HUB ASSEMBLY AND A BICYCLE TRAINER WITH A DECOUPLING HUB ASSEMBLY

BACKGROUND

Field of the Disclosure

The present disclosure is generally directed to bicycle trainers, and more particularly to a decoupling hub assembly and a bicycle trainer with a decoupling hub assembly that permits a bicycle to be used with a bicycle trainer.

Description of Related Art

Bicycle trainers are known in the art and are typically used for stationary indoor training on a bicycle. Existing or known bicycle trainers are sometimes configured such that a user is not able to use their own bicycle with the trainer. Some existing or known bicycle trainers are configured such that a user is required to at least partially dissemble and reassemble their bicycle to attach the bicycle to the trainer.

In one example, a bicycle trainer is known that has a cassette mounted to a housing of the trainer. The cassette is different from the cassette that is provided on the bicycle. To attach the bicycle to this type of trainer, the chain of the drive train on the bicycle must be removed from the cassette on the bicycle so that the rear wheel can be removed from the bicycle. When the bicycle frame is attached to the trainer, the chain on the bicycle must be wrapped around the cassette on the trainer before the bicycle frame can be fixed to the trainer. This process can be quite messy because the chain on the bicycle is typically oiled and dirty. The process of re-routing the chain from the bicycle's cassette to the trainer's cassette can be difficult and requires a degree of skill in order to manage the chain detachment and reattachment. Further, the new cassette on the bicycle trainer must be aligned and calibrated with the derailleur that is attached to the bicycle frame to ensure good shifting. Further, when the bicycle is removed from the trainer, the chain must be detached from the trainer's cassette. Also, when putting the rear wheel back on the bicycle and reattaching the chain to the bicycle's cassette, the bicycle cassette must be realigned and re-calibrated with the bicycle's derailleur.

SUMMARY

In one example, according to the teachings of the present disclosure, a bicycle trainer includes a stand, a resistance generating mechanism carried by the stand, and a decoupling hub assembly carried on the stand and including a torque coupler. The torque coupler is operably connected to the resistance generating mechanism. The torque coupler has a coupling portion configured and arranged to contact and engage a coupling part of a driver mechanism on a bicycle.

In one example, the coupling portion may be exposed to an exterior of the stand when a bicycle is not mounted to the bicycle trainer.

In one example, the stand can include a base and an upright extending up from the base. The coupling portion of the torque coupler can be exposed to an exterior of the upright.

In one example, the stand can include a housing. The coupling portion can be exposed to an exterior of the housing.

In one example, the coupling portion can be positioned on an exposed axial face on the torque coupler.

In one example, an exposed axial face of the torque coupler can include a plurality of teeth.

In one example, an exposed axial face on the torque coupler can include a plurality of teeth, each tooth having a shallow angled surface on a back side of the tooth.

In one example, the coupling portion of the torque coupler can be biased in a direction toward the exterior of the stand.

In one example, the coupling portion of the torque coupler can be resiliently biased by a compression spring toward the exterior of the stand.

In one example, the decoupling hub assembly can include a hub body connected to the torque coupler and can be rotatable about a hub rotation axis. A groove can be formed circumferentially around an exterior of the hub body.

In one example, the resistance generating mechanism can include a drive belt that is routed at least partially around a hub body within a groove in an exterior surface of the hub body.

In one example, a hub rotation axis can be defined by a hub axle tube disposed within a housing of the stand.

In one example, the decoupling hub assembly can include one or more bearings disposed radially between a hub body and a hub axle tube.

In one example, the bicycle trainer can include a connecting device with a connecting shaft extendable through the decoupling hub assembly. The connecting shaft can have a proximal end, a free end, and a length such that the free end can extend outward beyond the coupling portion of the torque coupler at the exterior of the stand.

In one example, the resistance generating assembly can include a drive belt.

In one example, the resistance generating assembly can include a torque or load measurement element.

In one example, the resistance generating assembly can include a flywheel.

In one example, the bicycle trainer can include a sensor for sensing a revolutions per minute (RPM) of the torque coupler or a portion of the resistance generating assembly.

In one example, the bicycle trainer can include a load subsystem for imparting a load to the resistance generating mechanism, a power subsystem for deriving a power input by a rider to the bicycle trainer during use, a speed subsystem for deriving a speed characteristic of the bicycle trainer during use, and a processor subsystem including a processor configured to communicate with the load, power, and speed subsystems and to control aspects of same.

In one example according to the teachings of the present disclosure, a decoupling hub assembly of a bicycle trainer includes a hub axle tube having a lengthwise bore therethrough and defining a hub rotation axis. The decoupling hub assembly also includes a hub body received over the hub axle tube and rotatable about the hub rotation axis. The hub body has a groove formed circumferentially around an exterior of the hub body. A torque coupler is rotatably fixed relative to the hub body and is seated in a cavity concentric with the hub rotation axis in one end of the hub body. The torque coupler has a through bore and a coupling portion on an exposed axial face. A connecting device has a connecting shaft that extends through the lengthwise bore of the hub axle tube and the through bore of the torque coupler. The connecting shaft has a proximal end with a lever, a free end with male mechanical threads, and a length such that the free end can extend outward beyond the coupling portion of the torque coupler. A plurality of teeth is provided on the exposed axial face of the coupling portion. The plurality of teeth is configured to engage mating teeth on a coupling part of a driver mechanism of a bicycle drive train. The coupling portion of the torque coupler is resiliently biased in a direction outward from the cavity.

In one example, the coupling portion of the torque coupler is resiliently biased by a compression spring in the direction outward from the cavity.

In one example, the decoupling hub assembly can include a plurality of bearings disposed radially between the hub body and the hub axle tube whereby the hub body can be rotatable relative to the hub axle tube about the hub rotation axis.

In one example, the hub body can have two ends and can be supported at or relatively near each end by one of the plurality of bearings.

In one example according to the teachings of the present disclosure, a bicycle trainer system includes a bicycle trainer having a stand, a resistance generating mechanism carried at least in part by the stand, and a decoupling hub assembly carried by the stand. The decoupling hub assembly includes a torque coupler operably coupled to the resistance generating assembly. The trainer system also includes a bicycle having a drive train, a frame, and a driver mechanism carried near a dropout of the frame. The drive train is rotatably carried on the frame and is arranged to drive rotation of the driver mechanism. The torque coupler has a coupling portion exposed to an exterior of the bicycle trainer. The driver mechanism has a coupling part. When a rear wheel of the bicycle is detached from the dropout of the frame and the drive train, the stand is configured to support the dropout of the frame. The coupling portion of the torque coupler is configured to detachably engage the coupling part of the driver mechanism to transmit torque in a torque transmitting or drive direction from the drive train to the resistance generating mechanism.

In one example, the drive train can include a cassette and a chain.

In one example, the coupling portion can be on an axial face of the torque coupler and can include a plurality of teeth exposed thereon. The coupling part of the driver mechanism can have an axial face with a plurality of mating teeth exposed thereon.

In one example, each tooth of a plurality of teeth on the torque coupler and each mating tooth of a plurality of mating teeth on the coupling part can have a shallow angled surface on a back side thereof.

In one example, the coupling portion of the torque coupler can be resiliently biased by a biasing force toward the coupling part of the driver mechanism.

In one example, a biasing force can be sufficient to maintain engagement between a plurality of teeth on the torque coupler and a plurality of mating teeth on the coupling part when the decoupling hub assembly is rotated in the torque transmitting or drive direction and an opposite freewheeling direction. A freewheel mechanism can be disposed to permit the coupling portion of the decoupling hub assembly to freely rotate relative to the drive train of the bicycle when the drive train is rotated in the freewheeling direction.

In one example, the coupling portion of the torque coupler is resiliently biased by a biasing force toward the coupling part of the driver mechanism.

In one example, the decoupling hub assembly can include a hub body rotationally fixed to the torque coupler and a hub axle tube carried on the bicycle trainer. The hub body and the torque coupler can be rotatable about a hub rotation axis defined by the hub axle tube.

In one example, a groove can be formed circumferentially around an exterior of a hub body coupled to the torque coupler. A drive belt of the resistance generating mechanism can be received in the groove.

In one example, the bicycle trainer system can include one or more bearings disposed radially between the hub body and the hub axle tube.

In one example, the bicycle trainer system can include a blind bore formed axially in the axial face of the driver mechanism. The blind bore can include female mechanical threads. A connecting device can have a connecting shaft extendable through the decoupling hub assembly. The connecting shaft can have a proximal end with a lever, a free end with male mechanical threads, and a length such that the free end can extend outward beyond the coupling portion of the torque coupler at the exterior of the stand. The free end of the connecting shaft can extend into the blind bore of the drive body assembly such that the male mechanical threads can engage the female mechanical threads.

In one example, the coupling portion of the torque coupler can be configured to engage the coupling part of the driver mechanism such that the coupling part and the coupling portion rotate in concert with one another in the torque transmitting or drive direction and in a freewheeling direction. A freewheel mechanism can be disposed such that the torque coupler can rotate freely relative to the drive train of the bicycle when operated in the freewheeling direction.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present disclosure is related to decoupling hub assemblies for bicycles and to bicycle trainers that incorporate such decoupling hub assemblies. The disclosed hub assemblies and trainers solve or improve upon the above-noted and/or other problems and disadvantages with prior known hub assemblies and trainers. The decoupling hub assemblies disclosed herein can be used to improve bicycle trainer design, construction, and use. The disclosed hub assemblies allow a rider to attach their own bicycle frame and cassette to the trainer without having to dissemble and reassemble the drive train of the bicycle. The disclosed bicycle trainers utilize a decoupling hub assembly configuration, which allows a user to remove the rear wheel from a bicycle frame without having to remove the cassette and chain of the drive train from the bicycle frame. The bicycle frame, and the bicycle's cassette and chain can then be coupled to the bicycle trainer. These and other objects, features, and advantages of the disclosed hub assemblies and trainers will become to those having ordinary skill in the art upon reading this disclosure.

Those having ordinary skill in the art should understand that the drawings and detailed description provided herein are for illustration only and do not limit the scope of the invention or the disclosure. The appended claims define the scope of the invention and the disclosure. The detailed description below may use terms such as "first", "second", "third", "top", "bottom", "left", "right", "front", "rear", or the like. Use of such terms is only intended for clarity and often merely to differentiate among parts and components having the same names. Use of such terms is not intended to limit the scope of the disclosure to a specific order, arrangement, or orientation of such parts or components unless specifically stated herein. Further, such terms may refer to bicycle mechanisms that are conventionally mounted to a bicycle and with the bicycle oriented and used in a standard manner, unless otherwise indicated.

Also, multiple embodiments of the disclosed hub assemblies and trainers may be disclosed and described herein. Each embodiment may have a specific combination of features, parts, components, functions, aspects, or the like. The scope of the disclosure is not intended to be limited solely to those specific combinations. Each of the disclosed features, parts, components, functions, aspects and the like may be employed independent of one another or in other combinations not specifically disclosed or described herein.

Figure 1:
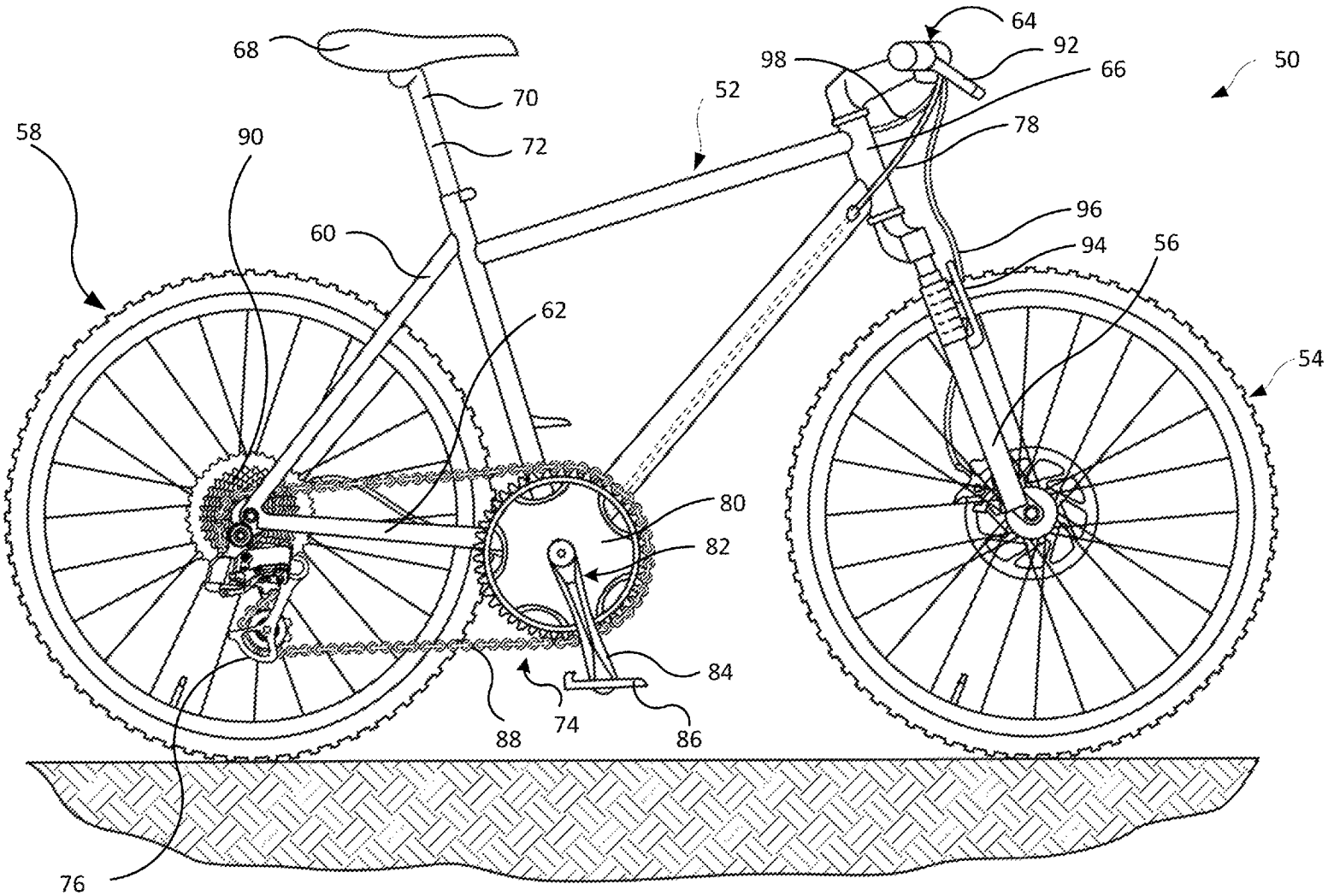
FIG. 1 shows a side view of one example of a bicycle in a conventional road-ready condition, the bicycle including a hub assembly in accordance with the teachings of the present disclosure.

Turning now to the drawings, FIG. 1 depicts one example of a bicycle 50 with a frame 52, a front wheel 54 coupled to a fork 56 of the frame, and a rear wheel 58 coupled to seat stays 60 and chain stays 62 on the frame. The wheels 54, 58 support the frame 52 above a surface on which the bicycle 50 can travel in a forward direction indicated by the arrow 'A'. The bicycle 50 has a handlebar assembly 64 that is mounted to a head tube 66 of the frame 52. The bicycle 50 also has a seat 68 carried by a seat post 70 received in a seat tube 72 of the frame 52.

The bicycle 50 has a multiple-geared drive train 74 that may have one or both of a front gear changer (not shown) and a rear gear changer mounted to the frame 52. The gear changers may be electromechanical derailleurs, for example, including a rear derailleur 76. The gear changers can be operable using a one or more gear shifters (not shown), which may be mounted to the handlebar assembly 64. The gear shifters may operate the gear changes through wireless communication or physical connection using a mechanical shift cable or hydraulic line 78. The drive train 74 includes with one or more chainrings 80 driven by a crank assembly 82, which has two crank arms 84 and two pedals, respectively 86. The chainrings 80 may be connected by a chain 88 to a plurality of sprockets on the frame 52 at the rear wheel 58. The plurality of sprockets may be identified as a cassette 90 mounted to the frame coaxial with the rear wheel 58. The bicycle 50 as described above is known in the art and is shown in FIG. 1 to be a mountain bike. Those having ordinary skill in the art should recognize that the type and style of bicycle may vary from the disclosed example. For example, a road bicycle with drop-style handlebars, along with a drivetrain having road type gearing with a road gear range may be used instead of a mountain bike or other bicycle gear range.

In this example, the bicycle 50 includes brake system. The brake system includes at least one brake lever 92 that is movably connected to the handlebar assembly 64. The brake lever 92 is configured to operate components of the braking system of the bicycle 50. In one example, the brake system can include one or both of a hydraulic or cable actuated front brake mechanism 94 coupled to the front wheel 54 via a hydraulic line or mechanical cable 96 and a hydraulic or cable actuated rear brake mechanism (not shown) coupled to the rear wheel 58 through a hydraulic line or mechanical cable 98. As noted above, the brake system can be a hydraulic actuated system or a mechanical actuated system and both are known in the art.

Figure 2:
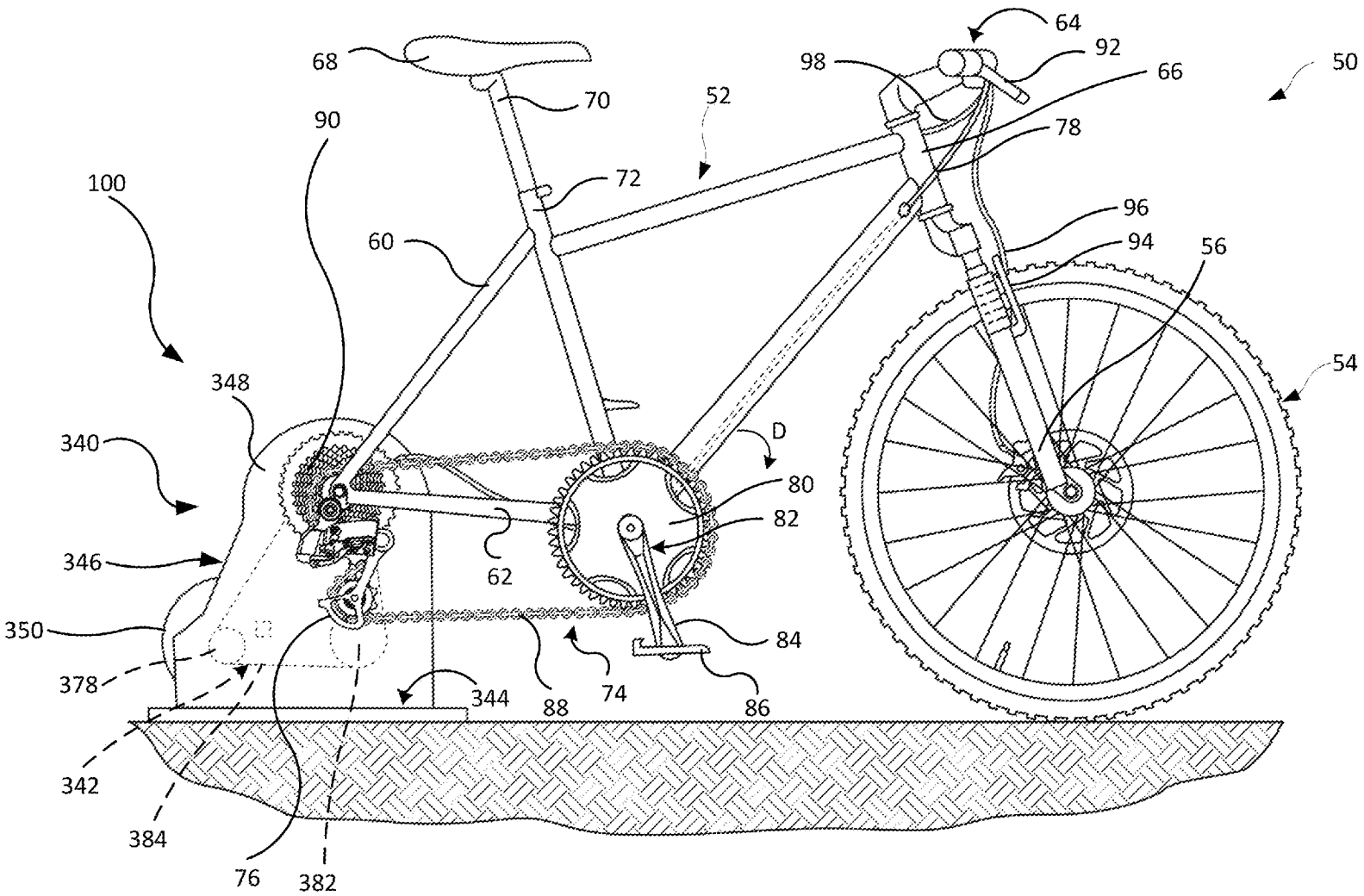
FIG. 2 shows a side view of bicycle trainer system in accordance with the teachings of the present disclosure and including the bicycle of FIG. 1, but in a reconfigured condition, attached to a bicycle trainer constructed in accordance with the teachings of the present disclosure.

FIG. 2 shows a bicycle trainer system including the bicycle 50 of FIG. 1 connected to a bicycle training device, i.e., a bicycle trainer 100 in accordance with the teachings of the present disclosure. In this example, the rear wheel 58 of the bicycle 50 is removed from the frame 52, leaving the drive train 74, including the cassette 90 and chain 88, intact on the bicycle. As discussed in greater detail below, with the bicycle attached and secured to the bicycle trainer, the rider can sit on the seat 68 of the bicycle 50 and operate the drive train 74 via the pedals 86 in a normal manner. The bicycle trainer 100 is configured to impart resistance to the drive train 74, as is known in the art, to simulate riding the bicycle 50 though the bicycle and the bicycle trainer 100 remain stationary. In an embodiment, one or more control components of the bicycle 50 may be attached and/or communicatively connected as a part of the bicycle trainer system. Attachment of the drive train 74 is described extensively herein. However, other control components may also be attached such that operation of the control components of the bicycle may provide control of the bicycle trainer system. For example, the brake system of the bicycle may be configured to communicate brake commands from a rider to the bicycle trainer system.

Figure 3:
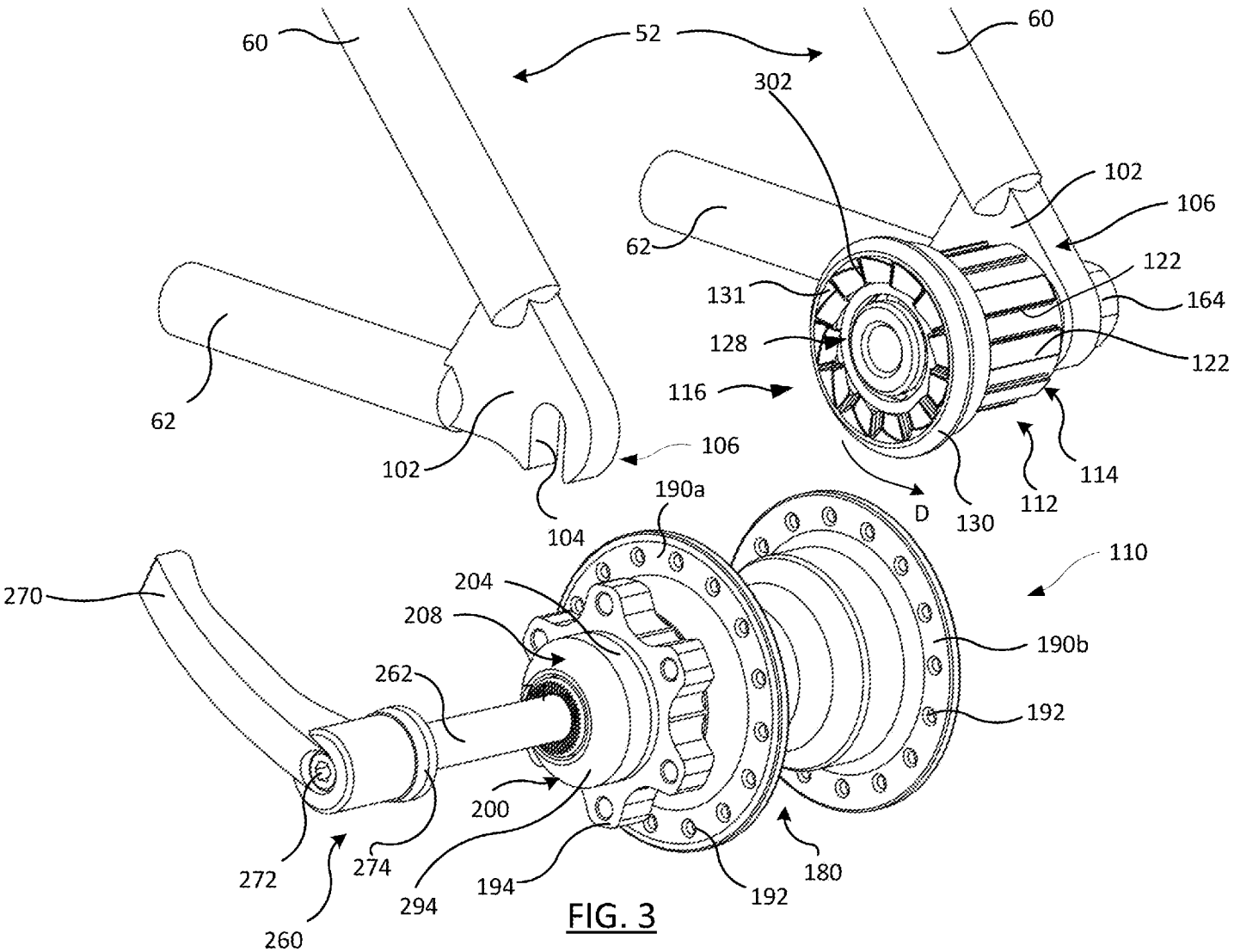
FIG. 3 shows a close-up perspective view of one example of the hub components of the rear wheel of the bicycle of FIG. 1, and with the hub components on the rear wheel and on a frame portion of the bicycle in a detached state.
Figure 4A:
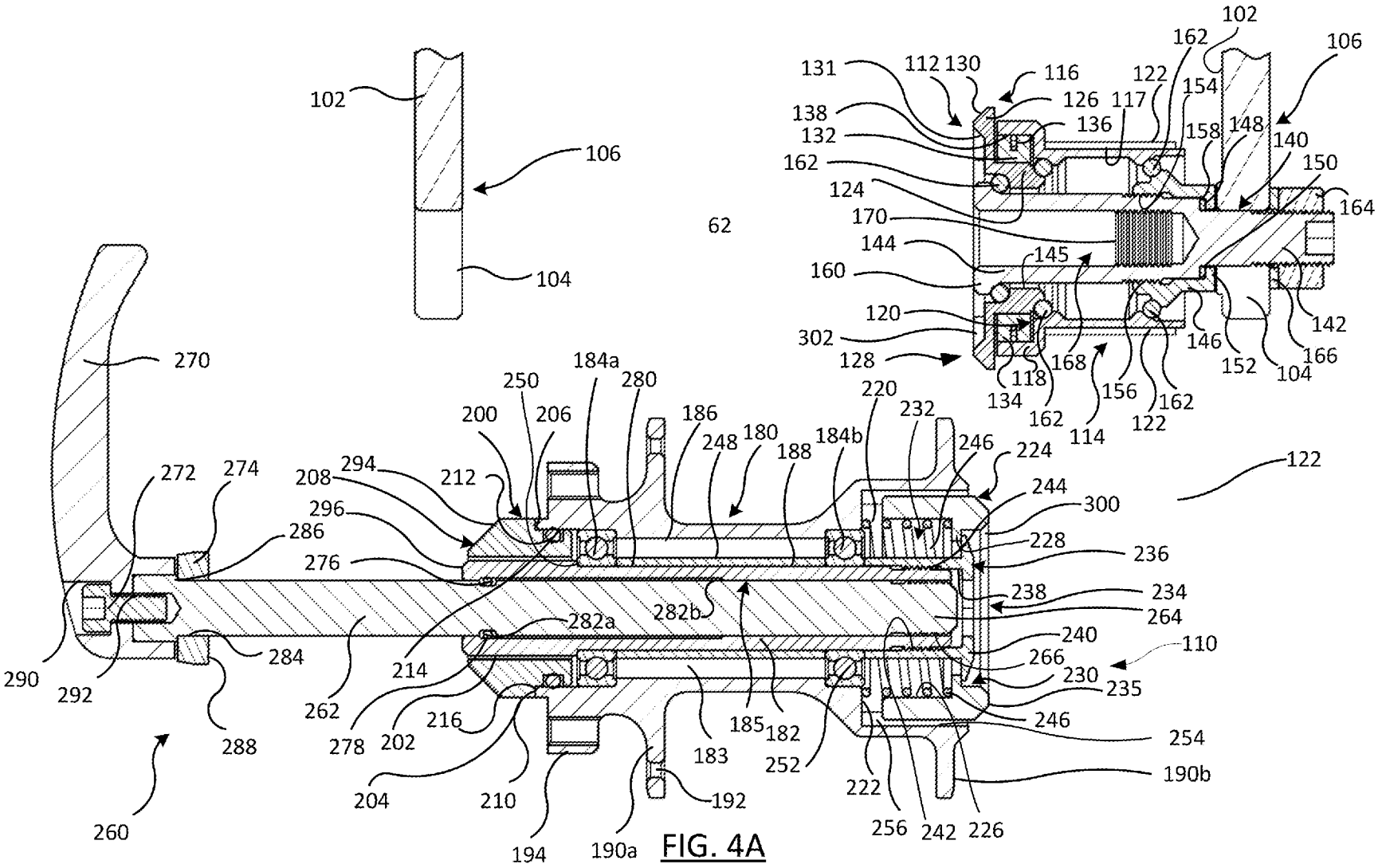
FIG. 4A shows a cross-section taken along lines 4A-4A of the hub components in the detached state of FIG. 3.
Figure 4B:
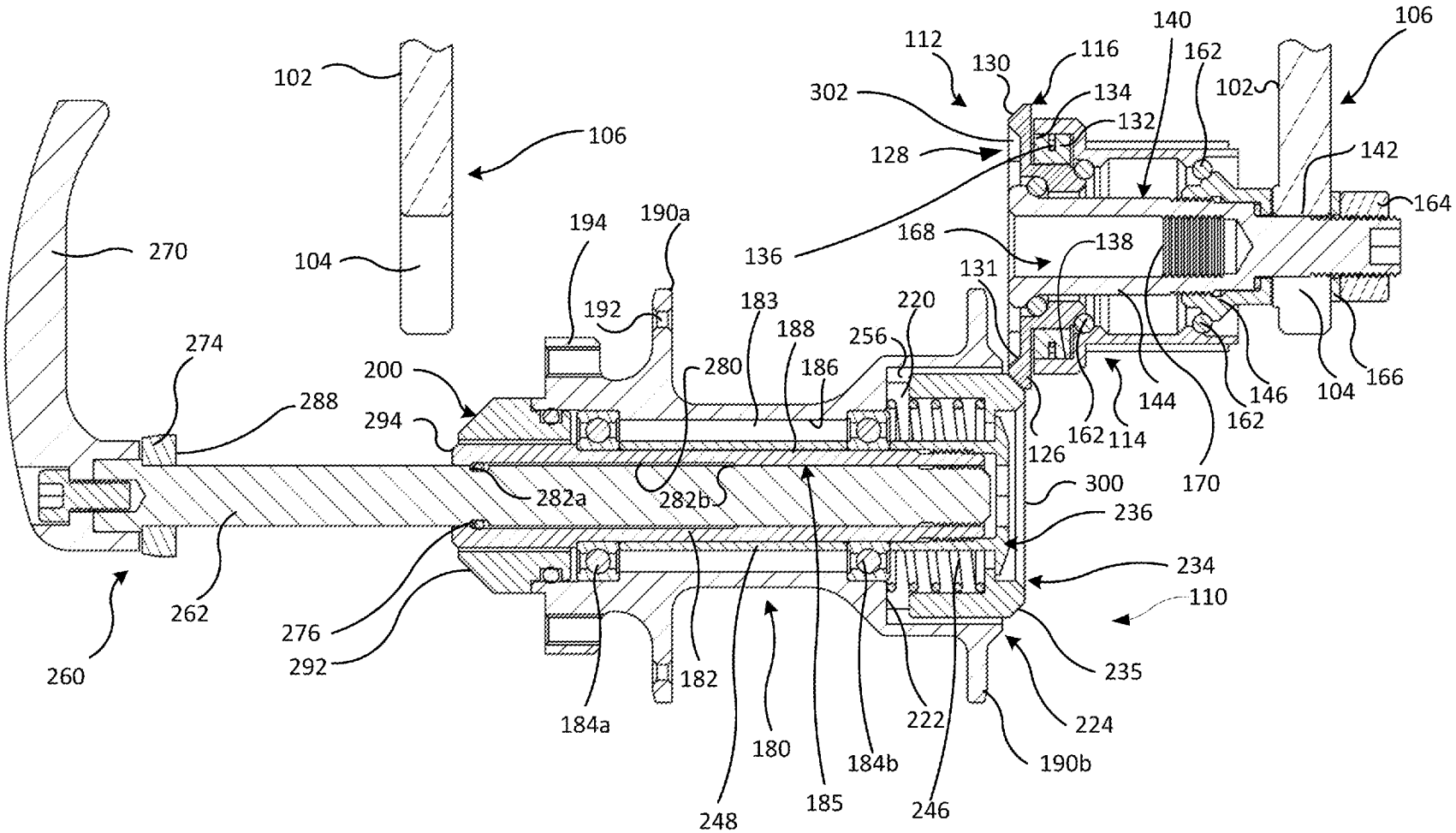
FIG. 4B shows the cross-section of the hub components of FIG. 4A, but in a partly attached state where the rear wheel is in the process of being attached to the frame portion.

FIG. 3 shows an exploded perspective view of part of the frame 52 and part of the rear wheel 58 of the bicycle and FIG. 4A shows a cross-section of the components in FIG. 3. In these views, the rear wheel 58 is shown without the spokes, tire, and rim being depicted. Also, only a frame portion of the frame 52 is depicted and includes parts of the seat stays 60 and chain stays 62 of the frame 52 near the rear wheel attachment point. As is known to those having ordinary in the art, the left and right chain stays 62 and left and right seat stays 60 may be joined to one another, respectively, such as by being welded to left and right flat plates 102, to form a wheel attachment portion of the frame 52. These flat plates 102 may have downward facing slots 104 for removably attaching the rear wheel 58 to the frame 52. In another embodiment, the wheel attachment portion may include one or more holes instead of slots. The flat plates 102 and slots 104 are commonly referred to, and are identified hereinafter, as dropouts 106. The cassette 90, chain 88, and rear derailleur 76 are also not shown. Thus, FIGS. 3 and 4A depict, in a disassembled or disengaged condition, the hub components at the rear wheel 58 of the bicycle 50 in this example.

Referring to FIGS. 3 and 4A, the hub components include a decoupling rear wheel hub assembly 110, which is carried at the rolling axis on the rear wheel 58 of the bicycle 50, and a drive train coupling assembly or mechanism, i.e., a driver mechanism 112, which is carried on the frame 52 of the bicycle. In this example, the driver mechanism 112 is mounted to the right wheel attachment portion, or dropout 106, on the frame 52. The driver mechanism 112 in this example has a drive body 114 and a coupling part 116 disposed at one axial end, i.e., an inward axial end of the drive body. The drive body 114 has a cassette section 117 that has a generally hollow cylindrical shape. The drive body 114 also has a radially larger section 118 at the one axial end. The larger section 118 is open in the axial direction and defines a circular space or receptacle 120 in the one axial end. The cassette section 117 and the larger section 118 are formed as a single integral piece in this example. However, these components can be made as two parts and then joined or fastened to one another.

The cassette section 117 has a circumferential outer surface and a plurality of splines 122 oriented in a lengthwise or axial direction along the outer surface. As is known in the art, the cassette 90 (not shown in FIGS. 3 and 4A) can include an internal splined bore that is received over the cassette section 117. The splined bore of the cassette 90 and the splines 122 of the driver mechanism 112 engage one another so that rotation of the drive body 114 rotates the splines 122, which drives rotation of the cassette 90 during normal operation of the bicycle 50 and its drive train 74.

The coupling part 116 of the driver mechanism 112 is received, at least in part, in the receptacle 120. The coupling part 116 has a cylindrical body portion 124 with an inward facing end that carries a driver disc 126. The driver disc 126 is a generally circular shaped disc and has an axial face 128 that is exposed at the one axial end of the drive body 114. The outer radial or peripheral edge 130 of the drive disc 126 has a chamfered or tapered profile in the inward facing direction and the inner radial or peripheral edge 131 of the drive disc has a chamfered or tapered profile, also in the inward facing direction. A freewheel mechanism has a freewheel body 132 that is circular in shape. The freewheel body 132 is disposed in the receptacle 120 of the larger section 118 and, in this example, is affixed to the body portion 124 of the coupling part 116. In another example, the freewheel body 132 can be formed as an integral part of the body portion 124 of the coupling part 116. The freewheel mechanism transmits torque from the cassette section 117 of the drive body 112 to the coupling part 116 of the drive body in a common manner that is well known in the industry. In the illustrated example, a plurality of pawls 134 are seated in pawl seats in the outer circumference of the freewheel body 132 and have tips that are biased radially outward, such as by a pawl spring 136. The larger section 118 of the drive body 114 includes a series of teeth (not shown) on a circumferential inner surface 138 that faces the freewheel body 132. The series of teeth engage the pawl tips of the pawls 134 to transmit torque from the drive body 114 to the coupling part 116, but only in a drive rotational direction only. Thus, the series of teeth and the pawls tips act as ratchet type teeth to engage in the drive direction but allow relative rotation in an opposite or freewheeling direction. Other freewheel mechanisms may also be used. For example, ratcheting plates or similar mechanisms may be used instead of pawls.

As shown in FIG. 4A, a pivot rod 140 has a bolt end 142 and an axle end 144 and is used to mount the driver mechanism 112 to the frame and to support the drive body 114 for rotation relative to the pivot rod 140. The coupling part 116 has a hole 145 and the pivot rod 140 is received through the hole to mount the coupling part and the drive body 114 to the pivot rod. A lock nut 146 is received over and attached to the pivot rod 140 to capture the coupling part 116 and the drive body 114 on the pivot rod. The pivot rod 140 has a shoulder 148 between the larger diameter axle end 144 and smaller diameter bolt end 142. The lock nut 146 has a through hole 150 formed axially through the lock nut and the bolt end 142 of the pivot rod 140 is received in the through hole of the lock nut. A radial inward flange 152 on the lock nut 146 defines a hole with a diameter that is smaller than the through hole 150 diameter, that is large enough to pass the bold end 142 of the pivot rod, but that is smaller than the diameter of the axle end 144 of the pivot rod 140.

The lock nut 146 can include internal threads 154 that screw onto external threads 156 on the axle end 144 of the pivot rod 140. The lock nut 146 bottoms out against a shim stack 158 between the shoulder 148 on the pivot rod 140 and the flange 152 on the lock nut 146. The shim stack 158 can be thin enough to remove axial play from the coupling part 116 and the drive body 114 and yet be thick enough to allow free relative rotation between the axle end 144 of the pivot rod 140, coupling part 116, and the drive body 114. Thus, when assembled, the coupling part 116 and the drive body 114 can be rotatable relative to each other (at least in the freewheeling direction) and relative to the axle end 144 of the pivot rod 140.

The distal or inward end of the axle end 144 on the pivot rod 140 has a flared edge 160 that is flared radially outward, increasing the diameter of the distal end, to aid in retaining the coupling part 116 and drive body 114 installed on the pivot rod when assembled. A plurality of bearings, such as ball type bearings 162, may be disposed between adjacent surfaces of the lock nut 146 and the drive body 114, between adjacent surfaces of the pivot rod and the coupling part 116, and/or between adjacent surfaces of the coupling part and drive body, as well as elsewhere in the driver mechanism 112, to permit relative free rotation between the parts. The bearings 162 can be configured to provide the bearing or free rotation function in a radial direction between the parts, in an axial direction between the parts, or both, as in this example.

The driver mechanism 112 is then mounted to the frame 52 of the bicycle 50. The exposed bolt end 142 is received in and through the slot 104 in one of the dropouts 106 on the frame 52, typically the right-hand side dropout. The bolt end 142 has exposed male mechanical threads. A washer 166 is installed and then a threaded nut 164 is screwed onto the bolt end 142. The lock nut 146 may have knurled face (not shown) that abuts against the dropout 106 when installed. The lock nut 146 and the nut 164 can have wrench flats (also not shown) for a tool to engage to tighten the nut when the driver mechanism 112 is installed to secure the pivot rod 140 in place on the dropout 106. The driver mechanism 112, when installed, extends inward in a direction toward the other dropout 106, i.e., the left-hand side dropout on the frame 52. The axle end of the pivot rod also has a blind bore 168 formed axially from the proximal end toward the shoulder 148. Female mechanical threads 170 are formed in the bore near the blind end, for reasons discussed further below.

Still referring to FIGS. 3 and 4A, the decoupling rear wheel hub assembly 110 includes a wheel hub unit 180 mounted for rotation about a hub axis on a hub axle tube 182. The wheel hub unit 180 has a generally cylindrical construction and has a bore 183 through the unit along the hub rotation axis of the unit. The hub axle tube 182 is received within and along the bore 183 and also has an axial through bore 185. A plurality of bearings 184 may be disposed radially between an adjacent inner surface 186 of the wheel hub unit 180 and outer surface 188 of the hub axle tube 182. The wheel hub unit 180 has two spoke flanges 190*a*, 190*b* spaced apart along the length of the unit and each extending radially outward from the unit. Each spoke flange 190*a*, 190*b* has a series of holes 192 for accepting wheel spokes (not shown) in a manner that is well known in the art. The wheel hub unit 180 also has brake rotor mounting bosses 194 that protrude radially outward from the exterior of the unit. The mounting bosses 194 have threaded holes for mounting a brake rotor (not shown) in a manner that is also well known in the art.

One open end of the wheel hub unit 180 is closed by an end cap 200. The end cap 200 has an axial bore 202 that is aligned with the hub rotation axis. An end of the hub axle tube 182 is received through the axial bore 202 in the end cap 200. The end cap 200 has a cylindrical outer surface 204 that is received in the bore 183 of the wheel hub unit 180. The end cap 200 has an annular shoulder 206 between the outer surface 204 and a larger diameter cap head 208 exposed to the outside of the wheel hub unit 180. The shoulder 206 abuts one terminal end 210 of the wheel hub unit 180. An O-ring 212 is seated in a groove 214 in the outer surface 204 of the end cap 200. The O-ring 212 is compressed between the groove 214 and an inner surface 216 of the bore 183 in the wheel hub unit 180. Friction created by the compressed O-ring 212 retains the end cap 200 fixed relative to wheel hub unit 180.

The other open end of the wheel hub unit 180 defines a cylindrical cavity 220, which has a diameter that is larger than the diameter of the adjacent portion of the bore 183. This diameter difference creates an internal shoulder 222 where the bore 183 of the unit transitions into the larger diameter cavity 220. The cavity 220 is open at the end of the wheel hub unit 180 and is also aligned with the axis of the unit.

A torque coupler 224 is received in the cavity 220 and has a round or cylindrical shape. The torque coupler 224 also has a through hole 226 that is aligned with the axis of the wheel hub unit 180. An annular flange 228 extends radially inward within and divides the axial through hole between a cap recess 230 on the outward facing side of the torque coupler 224 and a spring recess 232 on the inward facing side of the torque coupler. The torque coupler 224 has an axial face 234 that faces outward from the cavity 220 and that surrounds the cap recess 230. The outer radial or peripheral edge 235 of the torque coupler 224 has a chamfered or tapered profile in the outward facing direction.

The torque coupler 224 is retained therein by a hub retaining cap 236. The hub retaining cap 226 has a through hole 238 that is also aligned with the axis of the wheel hub unit 180. One end of the through hole 238 is formed in a head 240 of the hub retaining cap 236 and is hex shaped to accept a hex wrench (not shown). The other end of the through hole 238 in the hub retaining cap 236 includes female threads 242 and has a diameter configured so that the hub retaining cap can engage male threads 244 on the outer surface of and near the outward end of the hub axle tube 182 so that the retaining cap screws onto the axle tube. The hub retaining cap 236 is sized to fit within the cap recess 230 of the torque coupler through hole 226 and the head 240 is sized to bear against the annular flange 228.

A spring 246 or biasing element is captured within the spring recess 232 of the torque coupler through hole 226. One end of the spring 246 bears against the other side of the annular flange 228 and the other end of the spring bears against the shoulder 222 within the cavity 220. A cylindrical spacer 248 is captured between the axially spaced apart bearings 184*a*, 184*b* and is received over the outer surface of the hub axle tube 182. One of the bearings 184*a*, the left most bearing in FIG. 4A, is borne against a step 250 on the outer surface of the hub axle tube 182. When the hub retaining cap 236 is tightened using a hex wrench, its inward end 252 abuts against the other of the bearings 184*b*, the right most bearing in FIG. 4A. The hub retaining cap 236 thus clamps the adjacent bearing 184*b*, the cylindrical spacer 248, and the remote bearing 184*a* against the step 250 within the bore 183 of the wheel hub unit 180. The wheel hub unit 180 is then freely rotatable relative to the hub axle tube 182. The step 250 in the hub axle tube 182 abuts against the outer race of the bearing 184*a* and the end 252 of the hub retainer cap 236 abuts against the outer race of the other bearing 184*b*. This arrangement prevents the wheel hub unit 180 from moving axially relative to the hub axle tube 182.

As shown in FIG. 4A, the circumferential outer surface of the torque coupler 224 has external splines 254 that are axially oriented. The splines 254 engage with corresponding internal splines 256 on the inner facing surface of the cavity 220 in the wheel hub unit 180. Thus, the torque coupler 224 is axially movable within the cavity 220 but is rotationally fixed relative to the wheel hub unit 180 and thus will rotate in concert with the unit. The spring 246 in this example is seated against the internal shoulder 222 of the cavity and is borne against the annular flange 228, as noted above, and biases the torque coupler 224 outward relative to the cavity 220 and abuts the head 240 of the hub retaining cap 236, which acts as an outward direction travel stop for the torque coupler 224. Other torque coupler configurations, with or without splines as the torque transfer engagement mechanism, may be used.

The wheel hub components also include a connecting device 260 that secures the rear wheel hub assembly 110 to the driver mechanism 112. As shown in FIGS. 3 and 4A, the connecting device 260 has a connecting shaft 262 with a proximal end and a free or distal end 264. The distal end 264 of the connecting shaft 262 has male threads 266, which are sized to engage the female threads 170 in the blind bore 168 of the pivot rod 140 of the driver mechanism 112, as described further below. The connecting device 260 also has a lever 270 that is secured to the proximal end of the connecting shaft 262 by a screw 272. An abutment element or stop collar 274 is fixed near the proximal end of the connecting shaft 262 inboard of the lever 270. The connecting shaft 262 also has an O-ring 276 seated in a groove 278 in the shaft at a point along the shaft spaced from and between the proximal end and distal end 264.

The connecting shaft 262 is received in the through bore 185 of the hub axle tube 182. The O-ring 276 is squeezed between the groove 278 on the connecting shaft 262 and an axially lengthy but radially shallow recess 280 in the inner surface of the hub axle tube 182. Friction created by compression of the O-ring can provide some amount of resistance to axial movement of the connecting device 260 relative to the hub axle tube 182. The sliding friction generated by the compression of the O-ring 176 serves to hold connecting device 260 in a selected axial position relative to the hub axle tube 182. The connecting device is axially movable by overcoming this resistance. The travel distance of the connecting device 260 is limited by the axial length of the shallow recess 280, which is defined by terminal ends 282*a*, 282*b*. The O-ring 276 will contact one end or the other of the terminal ends 282*a*, 282*b*, which will thus act as left and right travel stops for the connecting shaft 262. The collar 274 has a central hole 284 that receives the connecting shaft 262. One side of the collar 274 abuts a shoulder 286 on the connecting shaft 262 near the proximal end. An opposite contact side 288 of the collar 274 is intended to abut against the end of the cap head 208 of the end cap 200. The contact side 288 of the collar 274 may have knurled surface feature (not shown).

Though not shown herein, the proximal end of the connecting shaft 262 may be splined and be received in a correspondingly splined bore 290 in the lever 270. These splines can allow rotational torque to be transmitted from the lever 270 to the connecting shaft 262. The lever 270 is secured by the screw 272 that is screwed into a threaded hole 292 in the proximal end of the connecting shaft 262. The lever 270 may be angularly or rotationally repositionable relative to the connecting shaft 262. The screw 272 and the lever 270 can be removed from the connecting shaft 262. The lever 270 can be rotated relative to the connecting shaft 262 to a desired rotational position and until the corresponding splines are aligned. The lever 270 can then be reattached by the screw 272 to the connecting shaft 262 in the desired angular orientation.

Figure 4C:
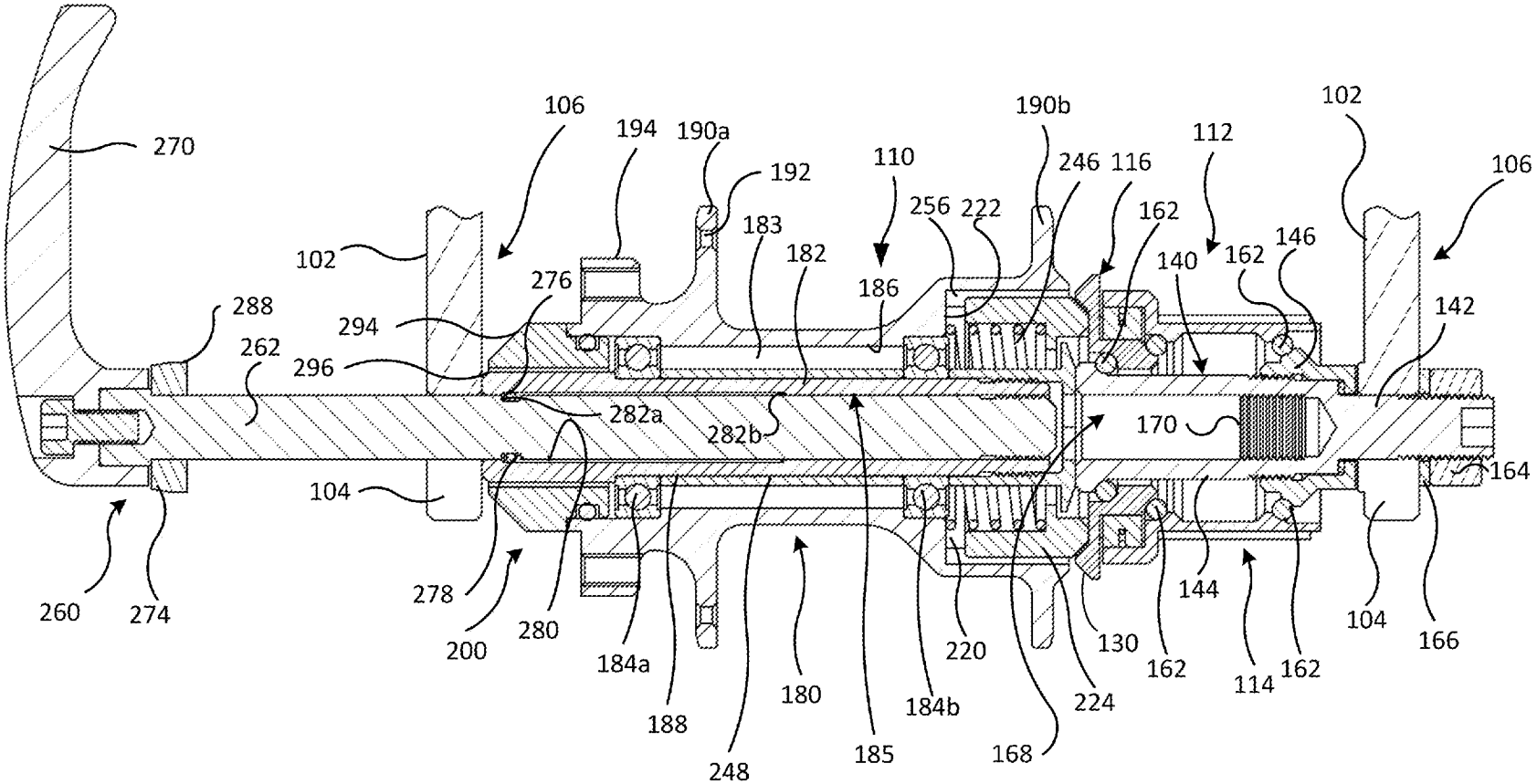
FIG. 4C shows the cross-section hub components of FIG. 4B, but in an unsecured but attached state where the rear wheel is attached but not yet secured to the frame portion.

Assembly of the rear wheel hub components is described herein with reference to FIGS. 3, 4A-4D, and 5. In normal use, this is done by dropping the dropouts 106 of the frame 52 toward the rear wheel hub assembly 110, or vice versa. The rear wheel hub assembly 110 and the driver mechanism 112, which is attached to the frame 52, are thus moved in a transverse direction toward one another from the spaced apart position of FIGS. 3 and 4A to a transition position shown in FIG. 4B. In this transition position, the tapered or angled edge 235 of the torque coupler and the outer tapered or chamfered edge 130 of the driver disc 126 are adjacent and contact one another. As the rear wheel hub assembly 110 and the driver mechanism 112 are moved closer to axial alignment, these angled surfaces, i.e., the angled edge 235 and the chamfered edge 130 act as ramps and will deflect the torque coupler 224 into the cavity 220 against the bias force of the spring 246, compressing the spring. With torque coupler 224 pushed into the cavity 220, the rear wheel hub assembly 110 and driver mechanism 112 can continue to move unimpeded in the transverse direction until the two parts are axially aligned with one another, as shown in FIG. 4C. The end cap 200 or an exposed end of the hub axle tube 182 may collide with the dropout 106 of the frame 52 during assembly. To alleviate any problem with assembly, a large chamfer or taper 294 can be provided on the cap head 208 of the end cap 200 and a smaller chamfer 296 can be provided on the end of the hub axle tube 182. The taper 294 and chamfer 296 can help to guide the rear wheel hub assembly 110 past the dropout 106 and into its final assembled position.

Figure 6:
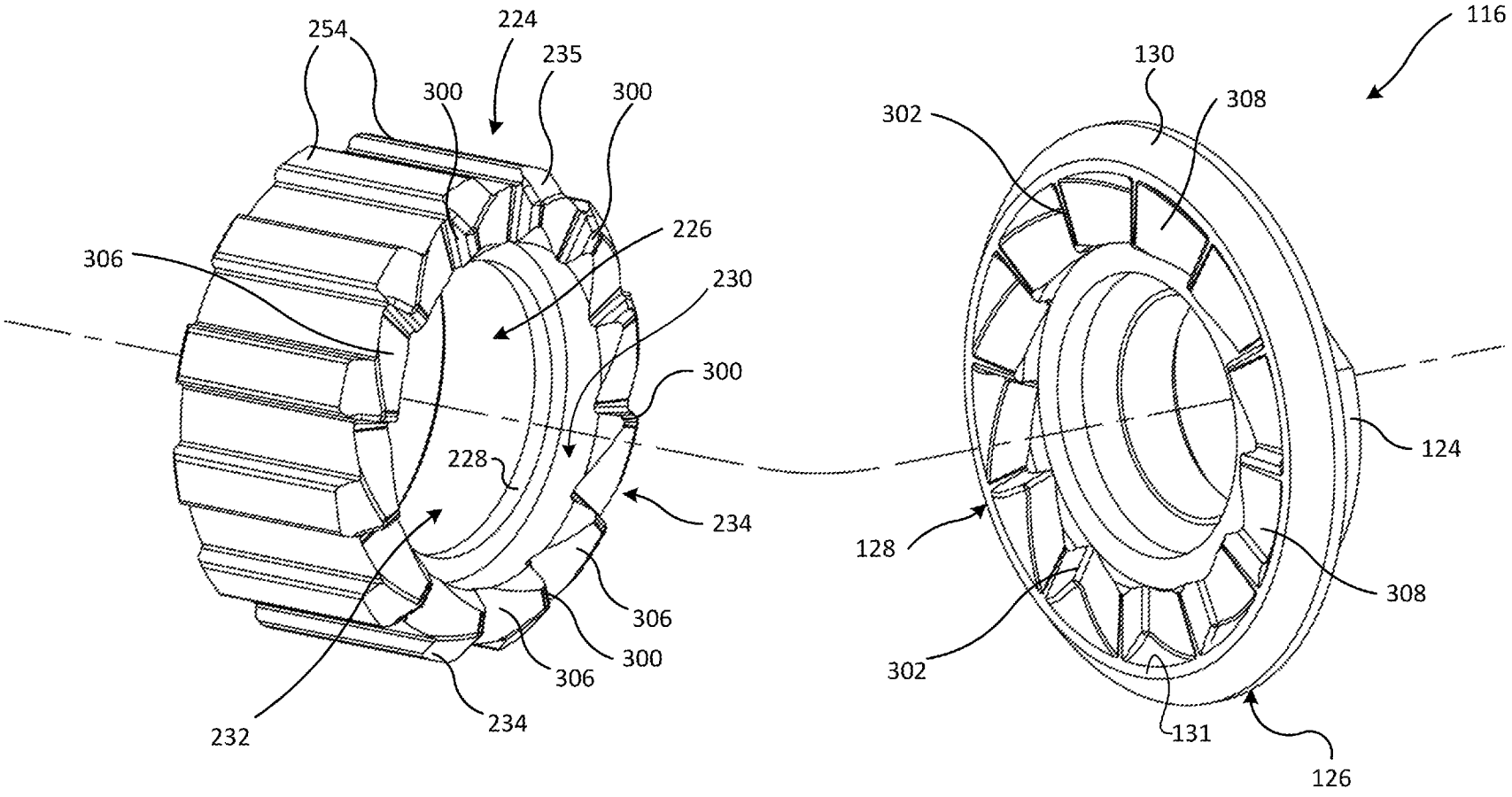
FIG. 6 shows an exploded perspective view of one example of the parts of the hub components depicted in FIGS. 3-5 that carry axial teeth and mating teeth, which engage the rear wheel and drive train of the bicycle to one another, and in accordance with the teachings of the present disclosure.

Once the rear wheel hub assembly 110 has reached the axially aligned position shown in FIG. 4C, the spring 246 will bias the torque coupler 224 into forced contact with the driver disc 126 of the driver mechanism 112. More specifically, referring to FIG. 6, the axial face 234 on the torque coupler 224 includes a plurality of teeth 300 thereon and the axial face 128 on the driver disc 126 of the driver mechanism 112 includes a plurality of mating teeth 302 thereon. These teeth 300 and mating teeth 302 engage one another when the wheel hub components are assembled, as is described further below. Further, the outer periphery at the tapered radial edge 235 of the torque coupler 224 in this example nests slightly within the inner periphery at the tapered radial inner edge 131 of the drive disc 126, as shown in FIG. 4C, and these edges slightly overlap one another in the axial direction.

Figure 4D:
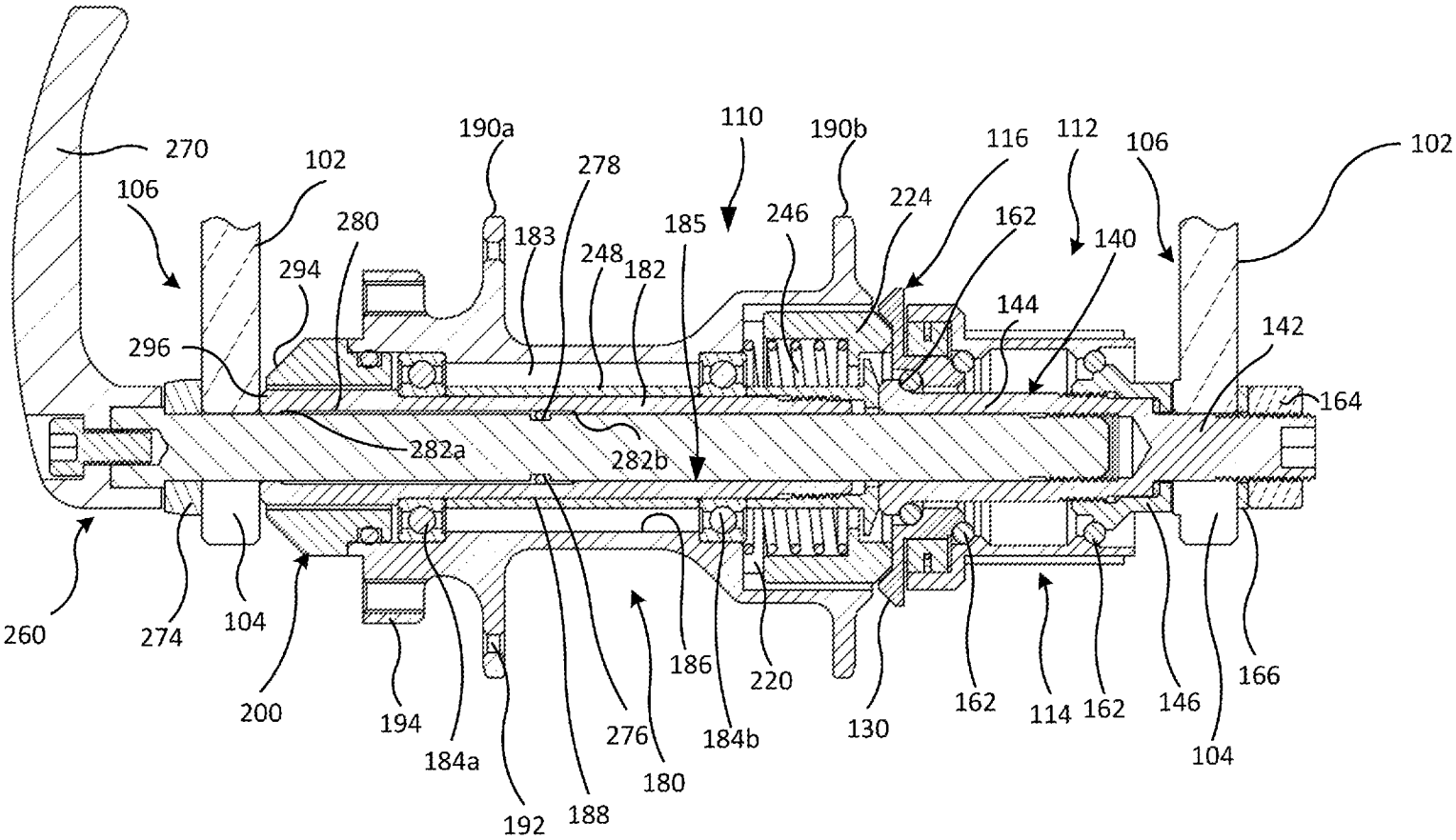
FIG. 4D shows the cross-section of the hub components of FIG. 4C, but in an attached and secured state where the rear wheel is secured to the frame portion.
Figure 5:
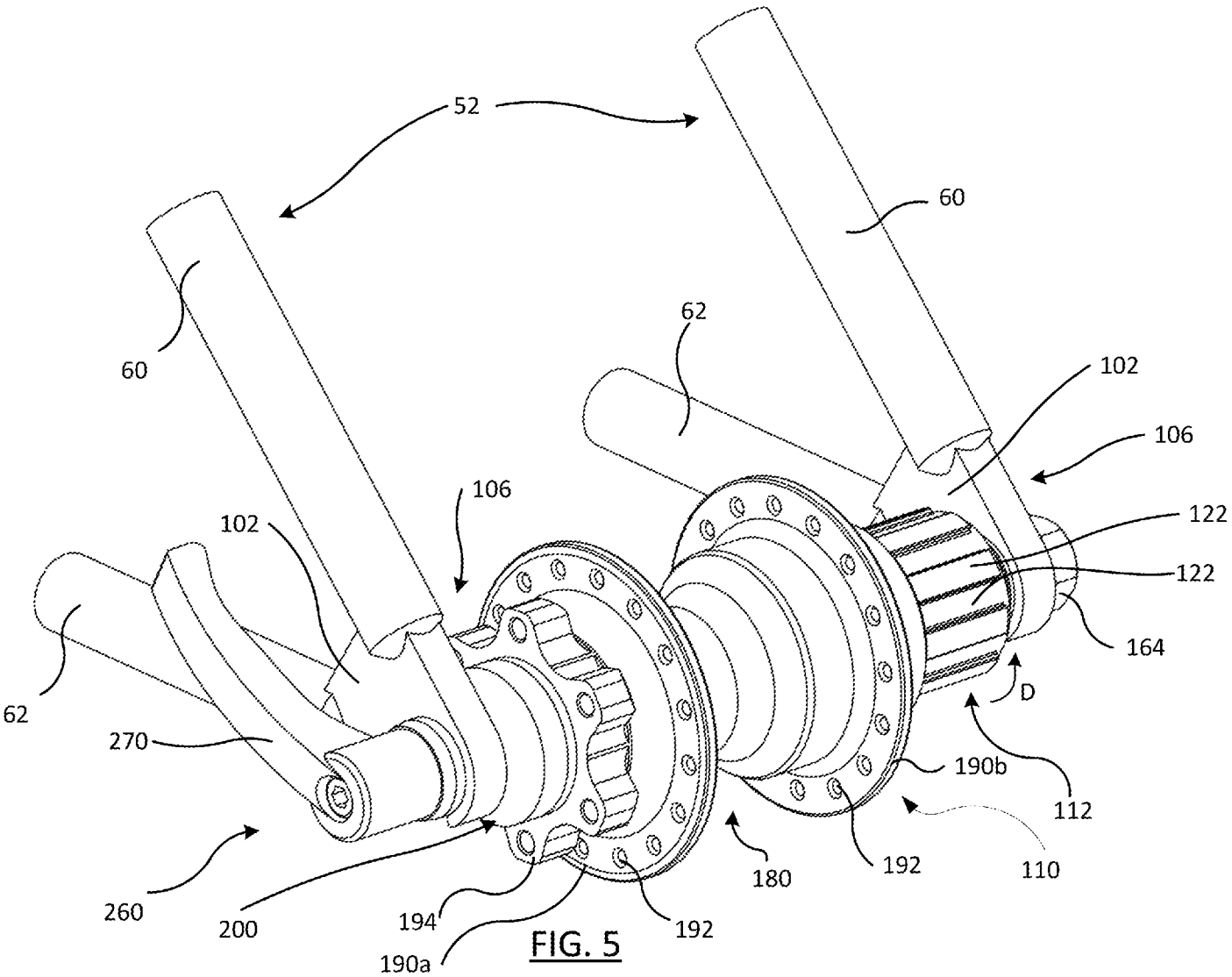
FIG. 5 shows a close-up perspective view of the hub components of the rear wheel of the bicycle of FIG. 3, but with the rear wheel and the frame portion in the attached and secured state of FIG. 4D.

Referring to FIGS. 4D and 5, once the rear wheel hub assembly 110 axis and driver mechanism 112 axis are aligned, the connecting device 260 can be secured. More specifically, the connecting shaft 262 is slid in an axial direction along the through bore 185 in the hub axle tube 182 until the distal end 264 slides into the blind bore 168 in the axle end 144 of the pivot rod 140. When the external or male threads 266 on the distal end 264 of the connecting shaft 262 contact the internal or female threads 170 in the blind bore 168, the lever 270 can be secured to assemble the wheel hub components. There may initially be a slight misalignment between the driver mechanism 112 and the connecting device 260. To alleviate potential alignment issues, a chamfered, tapered, or rounded end may be provided on the tip at the distal end 264 of the connecting shaft 262 and/or a tapered entry may be provided at the entrance to the blind bore 168 of the pivot rod 140 to help guide the connecting shaft 262 into engagement with the pivot rod 140. Once the parts are aligned and the male threads 266 of the connecting shaft 262 contact the female threads 170 in the blind bore 168 of the pivot rod 140, the lever 270 can be rotated to screw these threads 268, 170 into engagement until the contact side 288 of the collar 274 becomes tight against the dropout 106 of the frame 52. If, after assembly, the lever 270 is oriented in an undesirable angular position relative to the bicycle frame 52, the screw 272 may be unscrewed, the lever may be removed and re-oriented, as described above, and then and lever and screw may be reattached, also as previously described.

Figure 7C:
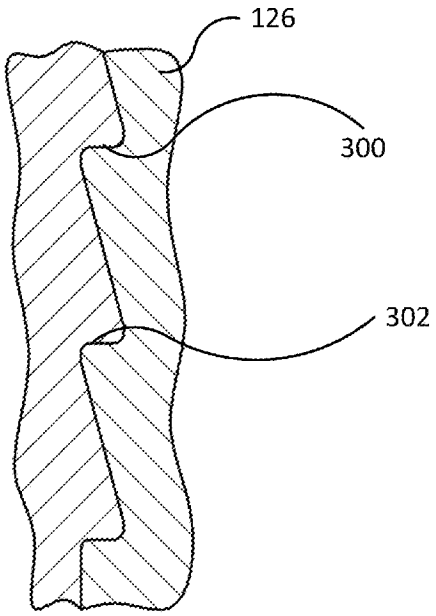
FIGS. 7A, 7B, and 7C sequentially show generic cross-sections of the axial teeth and the mating teeth on the hub components of FIG. 6 in disengaged, partially engaged, and fully engaged states, respectively.
Figure 7B:
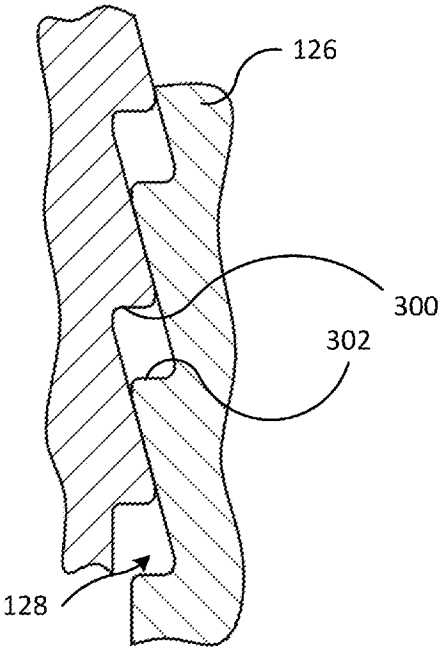
Figure 7A:
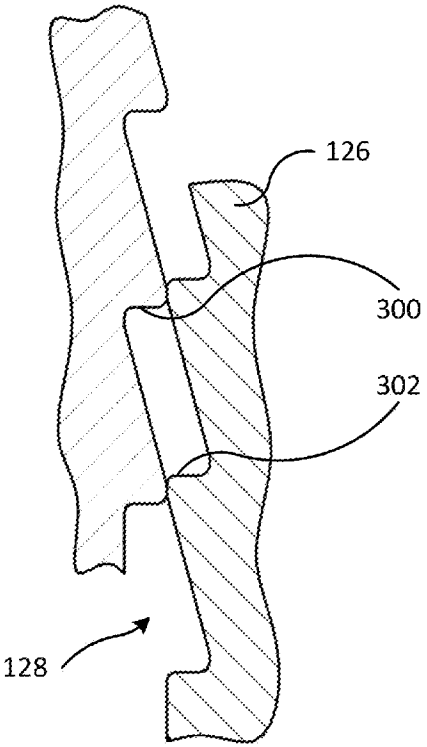

Referring to FIGS. 6 and 7A-7C, when the hub components are assembled, the plurality of teeth 300 on the axial face 234 of the torque coupler 224 will be in contact with and engage the plurality of mating teeth 302 on the axial face 128 of the driver disc 126. Once assembled, however, the teeth 300 and mating teeth 302 may be completely misaligned with one another, as in FIG. 7A, partially aligned and engaged with one another, as in FIG. 7B, or fully engaged with one another, as in FIG. 7C. When the cassette section 117 of the drive body 114 is rotated in a drive direction D by the cassette 90 and drive train 74, torque is transmitted from the cassette section via the pawls 134 to the freewheel body 132 and then to the driver disc 126 of the coupling part 116. This causes the driver disc 126 to rotate in the drive direction D. If the teeth 300 and mating teeth 302 are not engaged or only partially engaged, as shown in either FIG. 7A or 7B, respectively, the driver disc 126 will rotate in the drive direction D while the torque coupler rotates less or not at all. At the same time, the torque coupler 224 will be moved axially toward the driver disc by the biasing force of the spring 246 until the teeth 300 and mating teeth 302 are fully engaged with each other, as shown in FIG. 7C.

Once the driver disc 126 and torque coupler 224 are oriented as shown in FIG. 7C, their respective teeth are fully engaged and locked for co-rotation in the drive direction D. Torque applied via the drive train 74 and cassette 90 in the drive direction D can be transmitted from the driver disc 126 to the torque coupler 224. The torque is transmitted via the torque coupler 24 to the wheel hub unit 180 to drive rotation of the rear wheel 58. When the cassette section 117 of the drive body 114 is rotated in the direction opposite the drive direction D, i.e. when rotated in the freewheeling direction, small but unavoidable frictional forces are generated in the components. More specifically, small frictional forces will be generated between the larger section 118 of the drive body 114, the pawls 134, and the driver disc. This friction will transmit a very small amount of torque to the driver disc 126 in the freewheeling direction. It is undesirable during normal operation of the bicycle 50 for this torque to cause the driver disc 126 to rotate relative to the torque coupler 224 such that the teeth 300 and mating teeth 302 become disengaged or partially disengaged, as in FIG. 7A or 7B, respectively. This would result in a degree of rotational play that a rider would need to take up with the pedals 86 when the rider begins to pedal again in the driving direction D.

To avoid such undesirable play between the torque coupler 224 and the driver disc 126 during freewheeling, the plurality of teeth 300 and the plurality of mating teeth 302 are shaped such that there is no gap between them when fully engaged, as shown in FIG. 7C. The spring 246 can be designed to exert a relatively high force, at least in comparison to the force of the pawl spring 136, which can be designed to provide a relatively light force. Because there is no gap between the teeth 300 and mating teeth 302 in the circumferential direction when fully engaged, as shown in FIG. 7C, any relative rotational motion between the driver disc 126 and the torque coupler 24 would require the torque coupler to move axially into the cavity 220 against the relatively high or strong bias force of the spring 246, which can be strong enough to resist this movement or compression. The pawl spring 136 can be designed to have a relatively light force to minimize the torque transmitted to the driver disc 126 during freewheeling. Thus, relative rotation between the driver disc 126 and the torque coupler 224 can be avoided during freewheeling. In this example, once the wheel hub assembly 110 and rear wheel 58 have been installed on the frame 52 and once the drive body 114 is first rotated in the drive direction D to orient and fully engage the plurality of teeth 300 and the plurality of mating teeth 302, as shown in FIG. 7C, no further relative rotation between torque coupler 224 and the driver disc 126 should occur while the rider is riding the bicycle 50.

To remove the wheel hub assembly 110 and rear wheel 58 from the frame 52, the lever 270 of the connecting device 260 is rotated to unscrew or disengage the threads 266 from the threads 170 in the axle end 144 of the pivot rod 140. Once disengaged, the lever 270 can be pulled away from the wheel hub unit 180 to withdraw the connecting shaft 262 from the blind bore 168, as again depicted in FIG. 4C. The connecting device 260 can be withdrawn until the O-ring 276 contacts the terminal end 282*a* of the shallow recess 280 in the hub axle tube 182. The wheel hub assembly 110 can then be moved transversely relative to the driver mechanism 112. The external or outer angled or tapered peripheral edge 235 on the torque coupler 224 contacts the internal or inner tapered peripheral edge 131 on the driver disc 126. These angled surfaces, i.e., the tapered peripheral edge 235 and the tapered peripheral edge 131 again act as ramps and will move the torque coupler into the cavity 220 as the two parts move transversely relative to one another. Also, as shown in FIGS. 6 and 7A-7C, the plurality of teeth 300 and the plurality of teeth 302 can have shallow angled surfaces 306 and 308, respectively, that aid in disengaging the teeth and mating teeth. The surfaces 306 can slide along the surfaces 308, which also can push the surfaces 306 and thus the torque coupler 224 toward the cavity 220 against the bias force of the spring 246. In this manner, the wheel hub assembly 110 and rear wheel 58 can be completely detached and removed from the frame 52 and the driver mechanism 112, as again depicted in FIGS. 3 and 4A.

Figure 8A:
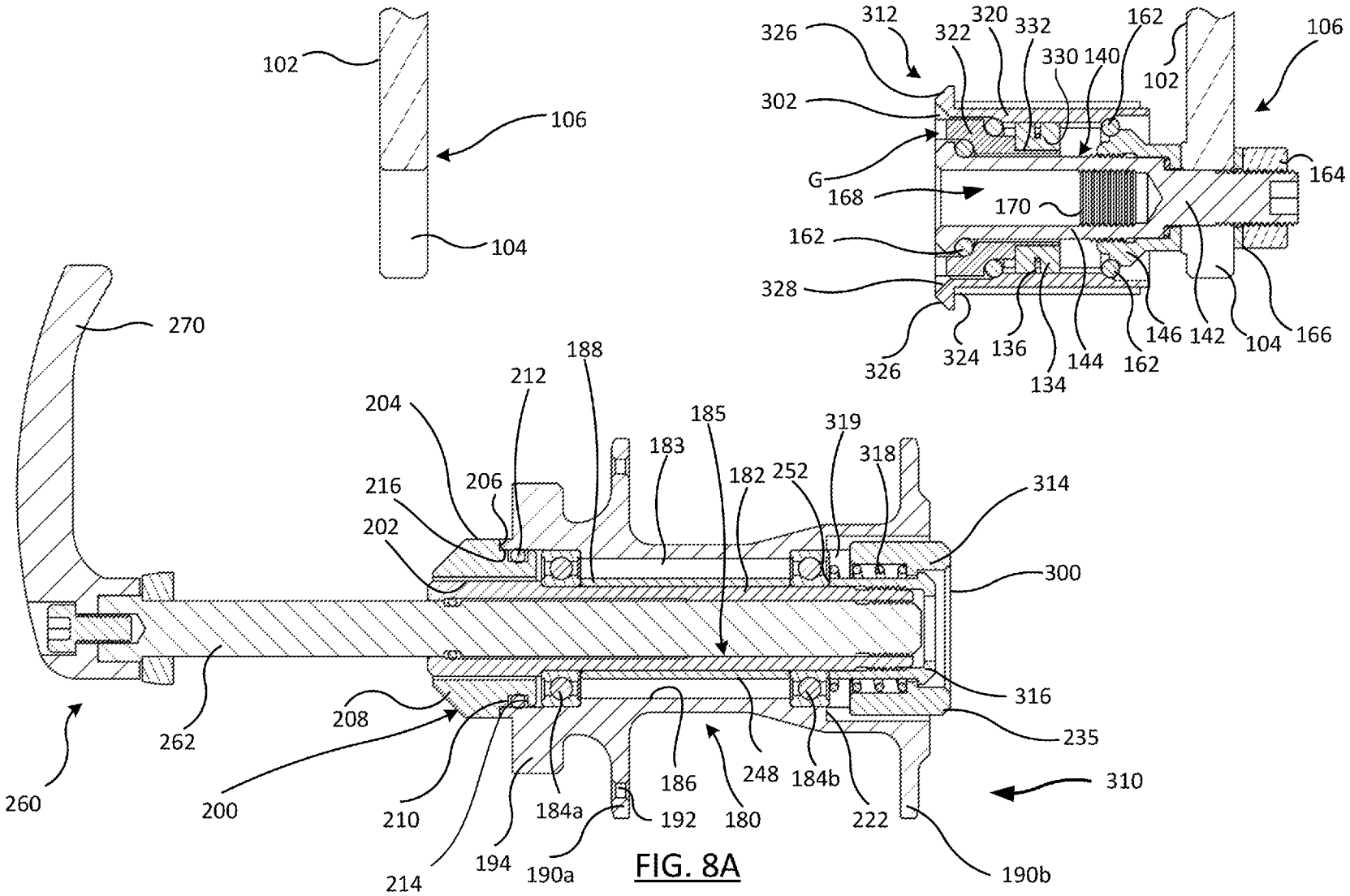
FIG. 8A shows a cross-section, like that of FIG. 4A, of another example of the hub components of a rear wheel for the bicycle of FIG. 1 in a detached state and in accordance with the teachings of the present disclosure.
Figure 8B:
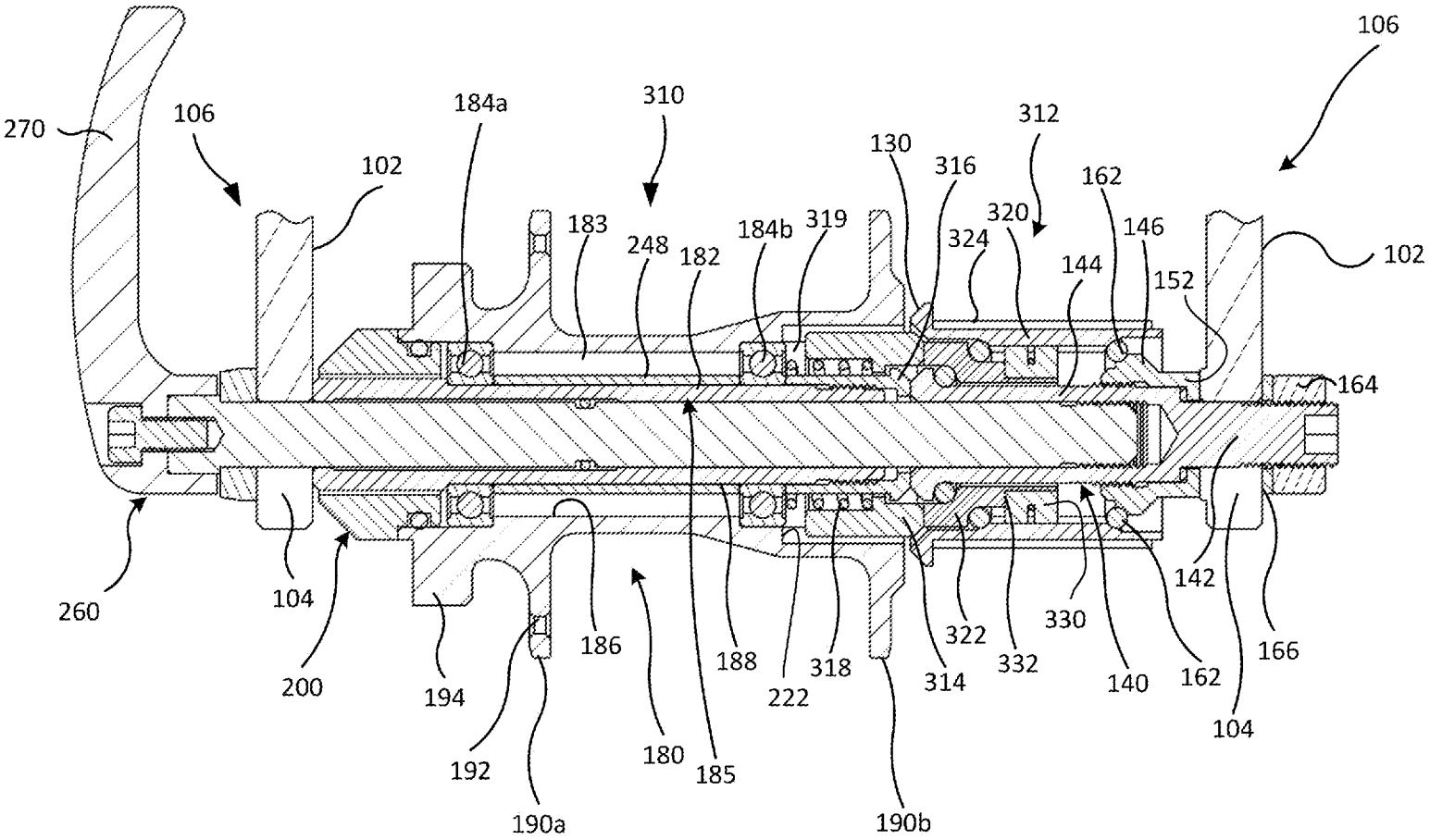
FIG. 8B shows a cross-section of the hub components of FIG. 8A, but in an attached and secured state, like that of FIG. 4D.

As noted above, the configuration and construction of the driver mechanism 112 and the wheel hub assembly 110 can be altered from the specific and detailed example described above and yet function and perform as intended. To illustrate, FIGS. 8A and 8B depict an alternate embodiment of a wheel hub assembly 310 and a driver mechanism 312 that are modified slightly from the above described example. In this example, the bulk of the parts are essentially the same as in the prior example, and thus are not discussed below and/or are given the same reference number as in the prior example.

In this example, one advantage is that any standard cassette 90 body (not shown) can be utilized because the splines on the cassette section are longer. FIG. 8A shows a cross-section of the wheel hub components of this example in a disengaged or detached state, like that of FIG. 4A above, and FIG. 8B shows the wheel hub components in an attached and engaged state, like that of FIG. 4D above. In this example, the wheel hub assembly 310 is substantially the same as the assembly 110 described above. The primary difference is that the torque coupler 314 is smaller in diameter, which permits use of a smaller diameter hub retaining cap 316, spring 318, and cavity 319. Otherwise the components of the wheel hub assembly 310 or substantially the same as, and function in the same manner, as that described above for the assembly 110. A modification to the driver mechanism 312, as described below, allows for use of the smaller diameter torque coupler 314, retainer cap 316, and spring 318.

In this example, the driver mechanism has a modified drive body 320 and modified coupling part 322. There is no driver disc on the coupling part and no larger diameter section on the drive body in this example. Instead, the drive body 320 is essentially a single diameter cylinder with axially extending splines 324 over the length of the outer surface of the drive body. The inward end of the drive body includes a radial flange that defines a tapered radial outward peripheral edge 326 and a tapered radial inward peripheral edge 328. These tapered edges 326, 328 were provided on the coupling part in the prior example. Also, in this example, a freewheel body 330 is disposed between two of the axially spaced apart bearings 162. The coupling part 322 in this example has an outward end that defines a seat 332 for the freewheel body 330, which is fixed in place in the seat. The freewheel body 330 again has pawls 134 that are biased by pawl springs 136 into engagement with teeth 334 formed on the interior surface of the drive body 320. Otherwise, the freewheel mechanism functions as described above for the prior example.

In this example, the coupling part 322 has an inward end that provides or defines the axial face and the plurality of teeth 302. These teeth 302 engage the plurality of teeth 300 on the torque coupler 314, as shown in FIG. 8B. The inward end and the teeth 302 on the coupling part 322 are exposed in a gap G between the inner tapered edge 328 of the drive body 320 and the axle end 144 of the pivot rod 140. The coupling part 322 is shaped to define races for the bearings 162 between the coupling part and the drive body 320 and between the coupling part and the pivot rod 140. As noted earlier, the diameter of the torque coupler 314 in this example can be considerably smaller than the diameter of the torque coupler 224 in the prior example. However, the torque coupler 314 functions in the same manner. The engagement and disengagement between the wheel hub assembly 310 and the drive mechanism 312 on the bicycle frame 52 is this example is also essentially the same as in the prior example.

In the foregoing examples, the rear wheel 58 of the bicycle 50 can be removed from the frame 52 rather easily. Also, in removing the rear wheel 58, the drive train 74 of the bicycle 50 essentially stays intact on the frame 52 and operational on the bicycle. The chain 88 stays engaged with the chain rings 80, the rear derailleur 76, and the cassette 90. The cassette 90 is a part of the driver mechanism 112, which also remains attached to the frame 52 when the rear wheel is removed. This arrangement provides for an improved ability to easily and readily transition the bicycle 50 between a normal riding mode, with the rear wheel 58 attached to the frame dropouts 106, and a stationary bike mode, with the dropouts attached to the trainer 100.

FIG. 2 shows the bicycle 50, with the rear wheel 58 detached from the frame 52, mounted to the bicycle trainer 100. In the disclosed example, the bicycle 50 can be attached to and detached from the trainer 100 in the same manner as the rear wheel 58 is attached and detached, as described above. The drive mechanism 112 (or 312) can stay mounted to the dropout 106 on the frame 52 of the bicycle 50, as can the entire drive train 74, including the chain 88 and cassette 90. The trainer 100 allows a rider to thus use most of their standard outdoor bike, while remaining indoors, simply by replacing the rear wheel 58 with the stationary trainer 100. The trainer 100 allows the rider to pedal and shift the bike as normal. In general, the trainer 100 creates a load against which the rider can pedal. The load may be adjustable, and the trainer may be configured to record relevant data, such as the duration, speed, and/or output work of the rider in various forms.

Existing trainers typically carry their own cassette. Thus, when the rear wheel is removed from the bicycle, the rider first must disengage the chain of the bicycle's drive train from the cassette mounted to the rear wheel. This can be an arduous and dirty process because the chain is typically dirty and oiled. The rear wheel and cassette are then removed together from the bicycle frame. Because these existing trainers have their own cassette, the rider must then wrap the chain of the bicycle around the cassette that is mounted on the trainer and then mount the bicycle, sans the rear wheel, to the trainer.

For proper and smooth shifting of the gears, it is also important that the rear derailleur gear positions be properly aligned with the cassette gear positions. With these types of traditional trainers, the trainer's cassette position is carried on the trainer whereas the rear wheel's cassette is carried on the hub of the rear wheel. Swapping out one cassette for the other can change the shifting characteristics of the bicycle. This is because the axial position of cassette on the rear wheel hub and the position of the cassette on the trainer may not be the same. Thus, once the bicycle is mounted to the trainer and the chain of the drive train is routed around the cassette of the trainer, the rear derailleur aligned, which may have been precisely aligned with the rear wheel cassette, may not be properly aligned with the trainer cassette. Therefore, in existing systems the rider often must calibrate the rear derailleur and trainer cassette alignment after the bicycle is mounted on the trainer for optimum shifting performance. Such calibration often needs to occur every time the bicycle is transitioned from trainer cassette to the rear wheel cassette, and vice versa. Calibration further adds to the time it takes to transition the bicycle between trainer mode and rear wheel mode. The disclosed rear wheel hub assembly, driver mechanism, and trainer examples greatly alleviate these problems.

FIG. 2 again shows the bicycle 50, sans the rear wheel 58, mounted to the trainer 100 according to the teachings of the present disclosure. This arrangement may be described as a bicycle trainer system. In general, the trainer 100 has a stand 340 that carries a resistance generating mechanism 342. The bicycle 50 50 is mounted to the stand 340 during use and the stand supports the entire rear end of the bicycle above the ground, floor, or support surface. The stand 340 should be configured to simulate the same riding position and orientation that would otherwise be provided by the rear wheel 58. In some examples, the stand 340 may have a height adjustment feature to allow the trainer to accommodate different bicycle frame and/or rear wheel sizes. The bicycle 50 should couple to the trainer 100 though the rear wheel rotation axis at a height that approximates the height of the rear wheel 58 that was removed. A mountain bike is shown as the bicycle 50 in the disclosed example. However, a road bike or any type of bike may be used with the trainer 100, and can include multi-gear, single gear, fixed gear, and even electric bikes in some applications. More specifically, the driver mechanism 112 or 312 and the frame dropouts 106 are connected to portions of the stand 340, as described below, to mount the bicycle. Once mounted, the resistance generating mechanism 342 can provide resistance to the drive train 74 of the bicycle 50 to simulate road riding conditions, including or within a desired gear range, such as a road gear range, as is known in the art.

The stand 340 in this example has a base 344 that rests on the support surface. The base 344 may be sized widthwise and lengthwise, as well as in thickness and overall structure, to provide lateral, i.e., fore-aft and side-to-side stability and durability during use when a bicycle 50 is mounted to the trainer 100 and a rider is using the system. The base 344 may otherwise vary considerably in configuration and construction. The base 344 is shown generically herein as having a relatively simple flat plate construction. The base 344 should provide sufficient support and stability during use so that the bicycle 50 and rider do not fall over to either side.

The stand 340 also has an upright 346 that is connected to and extends upward from the base 344. The upright 346, and its connection to the base 344, should also be stable and sturdy or strong enough to support the bicycle 50 and a rider during use. Otherwise, the configuration and construction of the upright 346 can also vary considerably and yet function as intended. In this example, the upright includes a housing 348 over the exterior of the upright. The housing 348, as well as the base 344, can be designed and configured to define the aesthetic industrial design characteristics for the trainer 100, as desired. The housing 348 can also be configured to expose only those components of the trainer 100 that are intended to be exposed while providing a protective and/or aesthetic cover for those components of the trainer that are intended to be hidden.

The base 344, upright 346, and housing 348 can be made from virtually any single material or combination of suitable materials, such as metal, wood, composites, engineered plastics, or the like. The size and shape of these parts of the stand 340 can also vary according to intended design and/or use parameters.

Figure 9:
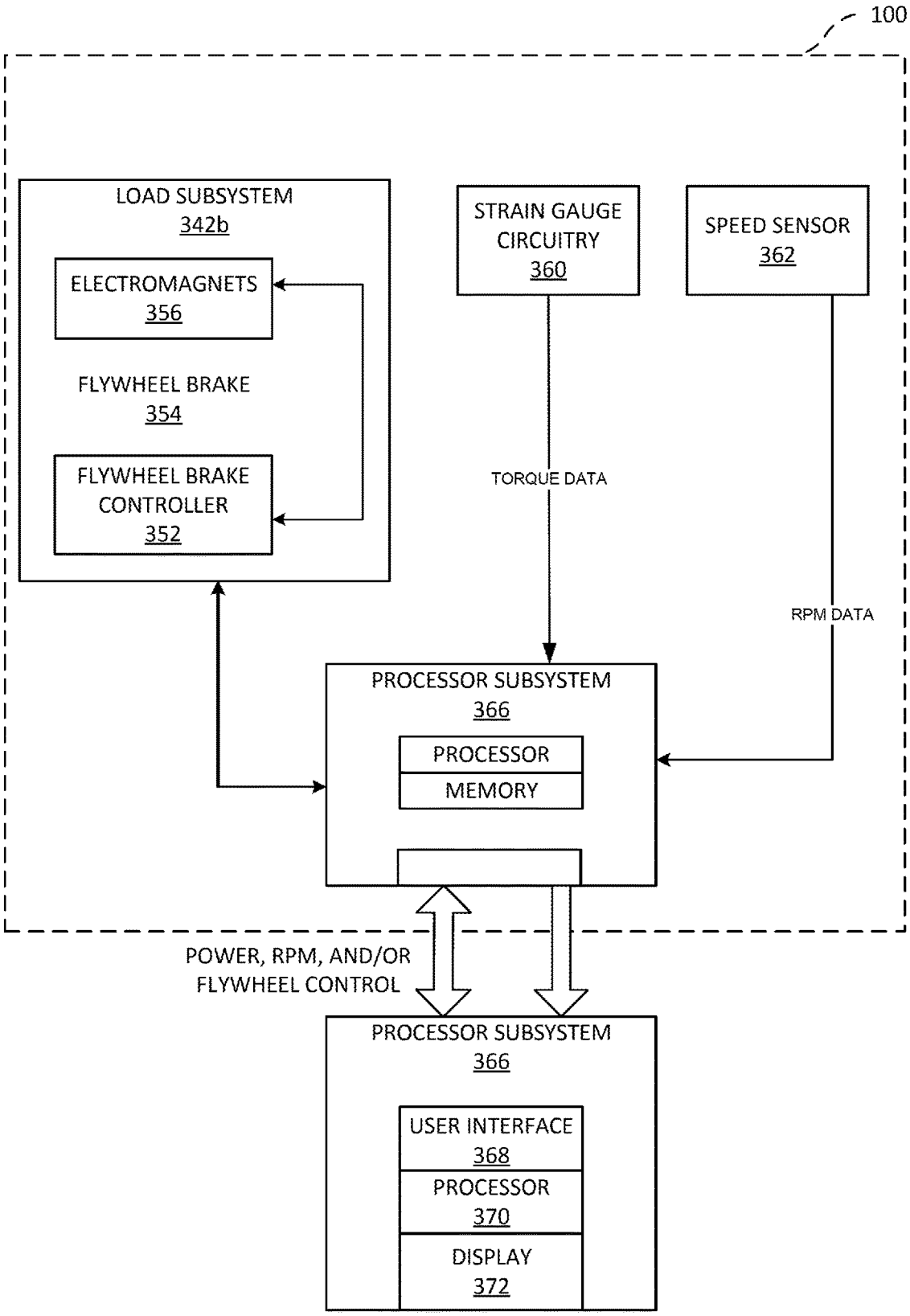
FIG. 9 shows a block diagram representative of one example of the operation of a bicycle trainer, such as that shown in FIG. 2, and in accordance with the teachings of the present disclosure.
Figure 10:
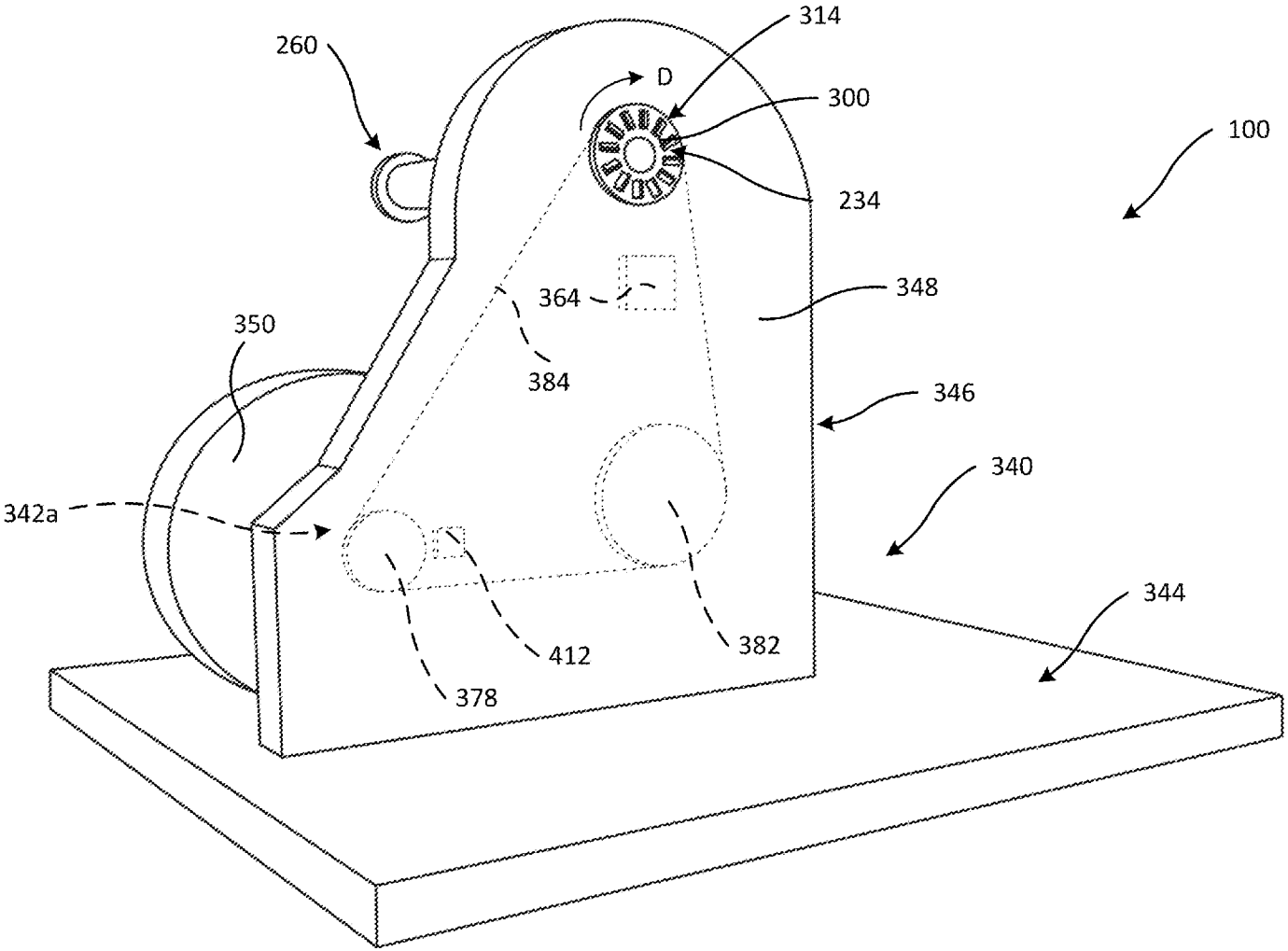
FIG. 10 shows a side perspective view of one example of a bicycle trainer, such as that depicted in FIG. 2 and represented in FIG. 9, and in accordance with the teachings of the present disclosure.
Figure 11:
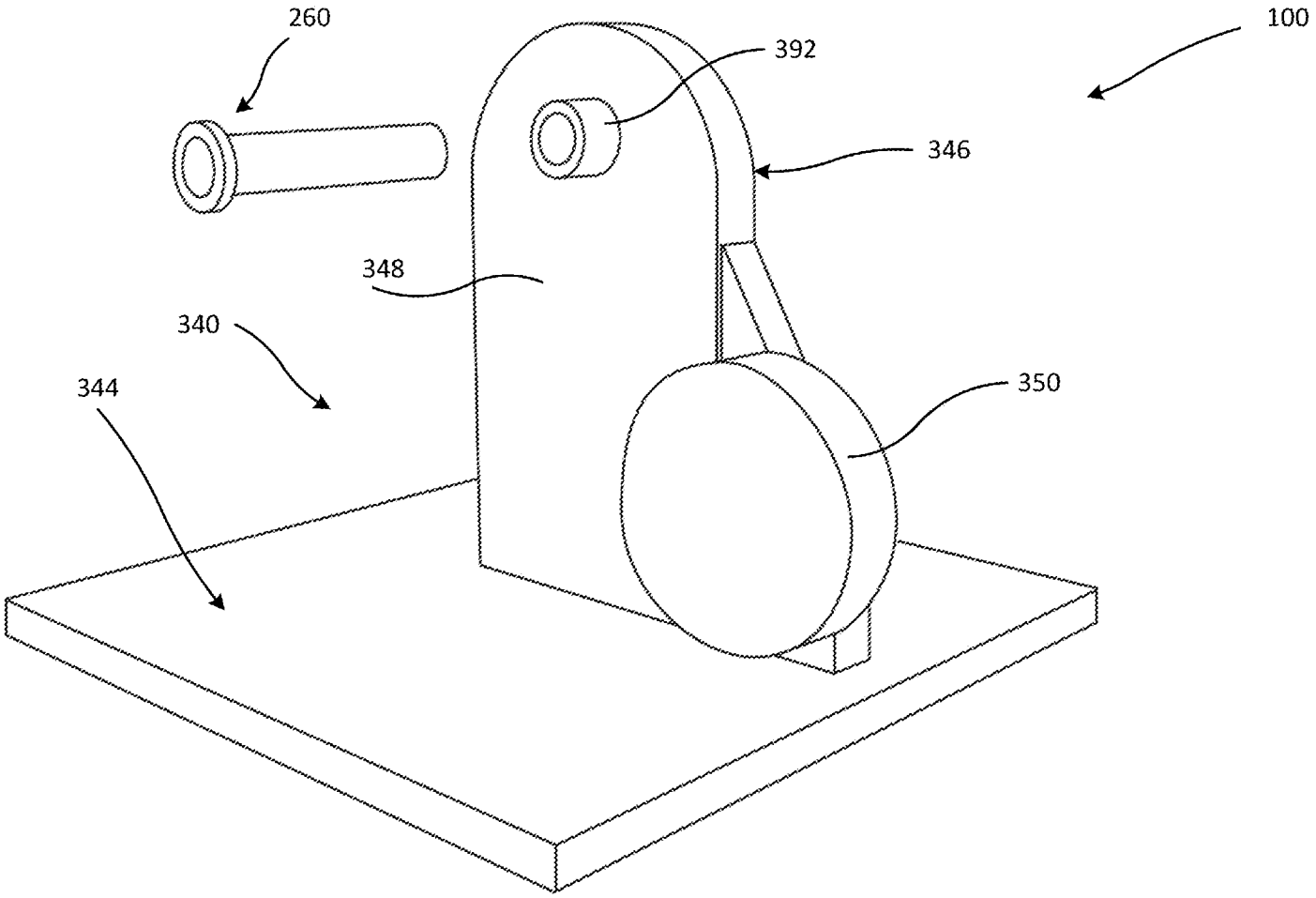
FIG. 11 shows an opposite side perspective and partially exploded view of the bicycle trainer of FIG. 10.

FIG. 9 shows a schematic of one example of the components and operational characteristics for the trainer 100 and FIGS. 10 and 11 show a perspective views of a version of the trainer. FIG. 9 depicts one example of a trainer 100 that has components, which may exist on stationary bike trainers. The components depicted within the dashed line boundary 100 in FIG. 9 may be provided as a part of the stand 340 of the trainer 100. In one example, the trainer 100 may include four separate subsystems. A first subsystem may be or may include the resistance generating mechanism 342*a*, shown also in FIGS. 10 and 11, and may be otherwise identified as a load subsystem, such as the load subsystem 342*b* as indicated in FIG. 9. The load subsystem may be virtually any suitable mechanism or device that can generate a load or impart rotational resistance that will be applied to or seen by the drive train 74 of the bicycle 50. There are different types of resistance generating mechanisms that are known in the art.

In one example, the load subsystem 342*b* can include a flywheel 350 that rotates relative to the stand 340. Rotation of the flywheel 350 may be controlled by a brake controller 352 and a flywheel brake 354. The flywheel 350 may also include electromagnets 356 that are deployed to actuate the flywheel brake 354 on the flywheel 350. However, other load or resistance generating mechanisms may certainly be used, such as fluid braking, friction braking, and the like to the same effect. In the disclosed example, the purpose of the flywheel 350 is to impart some momentum to the system similar to getting a bicycle up to speed outdoors. The purpose of the flywheel brake 354 is to provide rotational resistance to the system to approximate the forces experienced while riding outdoors, such as when climbing a hill or riding against the wind. In most trainers, the resistance is adjustable by the rider during use.

The second subsystem of the trainer 100 in this example is a power subsystem 360. The purpose of the power subsystem 360 is to measure the input force required of the rider to pedal the bicycle to derive the power delivered or input by the rider to the trainer 100 during use. Thus, the rider's level of exertion can may be determined by this subsystem 360. In one example, the power subsystem 360 may employ or include one or more load cells or strain gages that are deployed to measure the load by physical displacement in the gages. The displacement data can be converted to electrical signals, which can be used to derive the rider's power output. Any other suitable means, device, or mechanism to derive power input may be used with the trainer 100. These other options may include optical sensors, bending sensors, Hall effect sensors, temperature and vibration (noise) related sensors, and the like. Also, the power subsystem 360 can employ the sensors or gages anywhere in the components of the trainer that will yield the appropriate data. Alternatively, the power subsystem 360 can employ sensors or gages on the bicycle that will yield the appropriate data, but the sensors or gages must be coupled to the trainer, either directly or indirectly, though remote from the trainer during use.

The third subsystem of the trainer 100 in this example is a speed subsystem 362. The speed subsystem 362 is used to obtain data that is representative of the speed of the rider, such as in revolutions-per-minute (RPM). The speed can be measured directly by deploying a remote speed sensor (not shown) near the crank assembly 82 on the bicycle 50. Thus, no matter what gear the rider is using, the rider's cadence can be measured directly. However, this would require a sensor that is coupled, directly or wirelessly, to the trainer 100 but that can be attached to the bike 50, remote from the trainer. In another example, knowing the current gear of the bicycle and then measuring the RPM of the drive mechanism 112 or 312 or the flywheel 350 with a sensor 364, the crank RPM can be accurately derived. Additionally, the gear data can be logged or stored, along with a data set that can include crank speed or RPM data, power data, wheel speed data, gear ratio over time data, and/or the like.

The fourth subsystem of the trainer 100 in this example is a processor subsystem 366. The processor subsystem 366 can include a user interface and/or display 368 that is configured to receive input from the rider and/or to display information to the rider. The user input may be a simple panel with buttons or actuators to turn the trainer 100 off and on and to operate and control different subsystems and other functions of the trainer 100. The processor subsystem 366 can also include a processor 370 or microprocessor that is programmed and configured to provide or control various desired functions of the trainer 100. The processor 370 can be configured to communicate with the other subsystems of the trainer 100, and to optionally communicate with other systems on the bicycle 50. The processor 370 can be programmed and configured to measure or derive the load applied based on data transmitted from the load subsystem 342*b*, as well as the rider input power and RPM based on data transmitted by the power and speed subsystems 360 and 362. The processor can also be programmed and configured to simultaneously control the resistance of the flywheel 350 or resistance generating mechanism 342 through rider input or programmed input from the processor. The load, power, and speed subsystems 342*b*, 360, 362 may be wired or wirelessly coupled to the processor subsystem 366 as well as to one another, as desired. A separate display 372 may be connected to the trainer 100 and, more specifically to the processor subsystem 366, by wire or wirelessly. The separate display 372 may be on the trainer, on computer on the bicycle, on a remote computer, on a smart phone, or on another remote display. The processor subsystem 366 may control the ride resistance in a way that is manually controlled by the rider, is part of a preprogrammed routine based in the processor or display, or that is based on some externally driven program as part of a multiplayer online ride event or simulator. The processor subsystem 366 and the processor 370 can vary in configuration and function.

Referring again to FIGS. 10 and 11, the trainer 100 has the stand 340 that includes the base 344 and the upright 346. The housing 348 provides a protective and ornamental design function for the components, including the above-mentioned subsystems, that are supported or carried by the upright 346. As shown in these figures, the resistance generating mechanism 342 and load subsystem 342*b* can include the flywheel 350, which is carried on a flywheel shaft 378 that is mounted for rotation on the upright 346. A trainer hub assembly 380 is deployed substantially within the housing 348 and carried by the upright 346. As described in greater detail below, the trainer hub assembly 380 functions similar to the above described rear wheel hub assemblies 110 and 310. The resistance generating mechanism 342 and load subsystem 342*b* can also include a pulley 382, which is also mounted for rotation on the upright 346 and disposed within the housing 348. The flywheel shaft 378, pulley 382, and trainer hub assembly 380 are disposed spaced apart from one another on the upright 346. The trainer hub assembly 380 is located above the other two components and is positioned or positionable at the height of the rotation axis of the rear wheel 58 of the bicycle 50, as noted above. A drive belt 384 or chain is routed around the flywheel shaft 378, the pulley 382, and the trainer hub assembly 380 within the housing 348 of the upright 346, as depicted in FIG. 10. As a rider pedals the bicycle, the trainer hub assembly will be rotated, which will rotate the drive belt 384, which in turn will rotate the pulley 382 and the flywheel 350.

Figure 12:
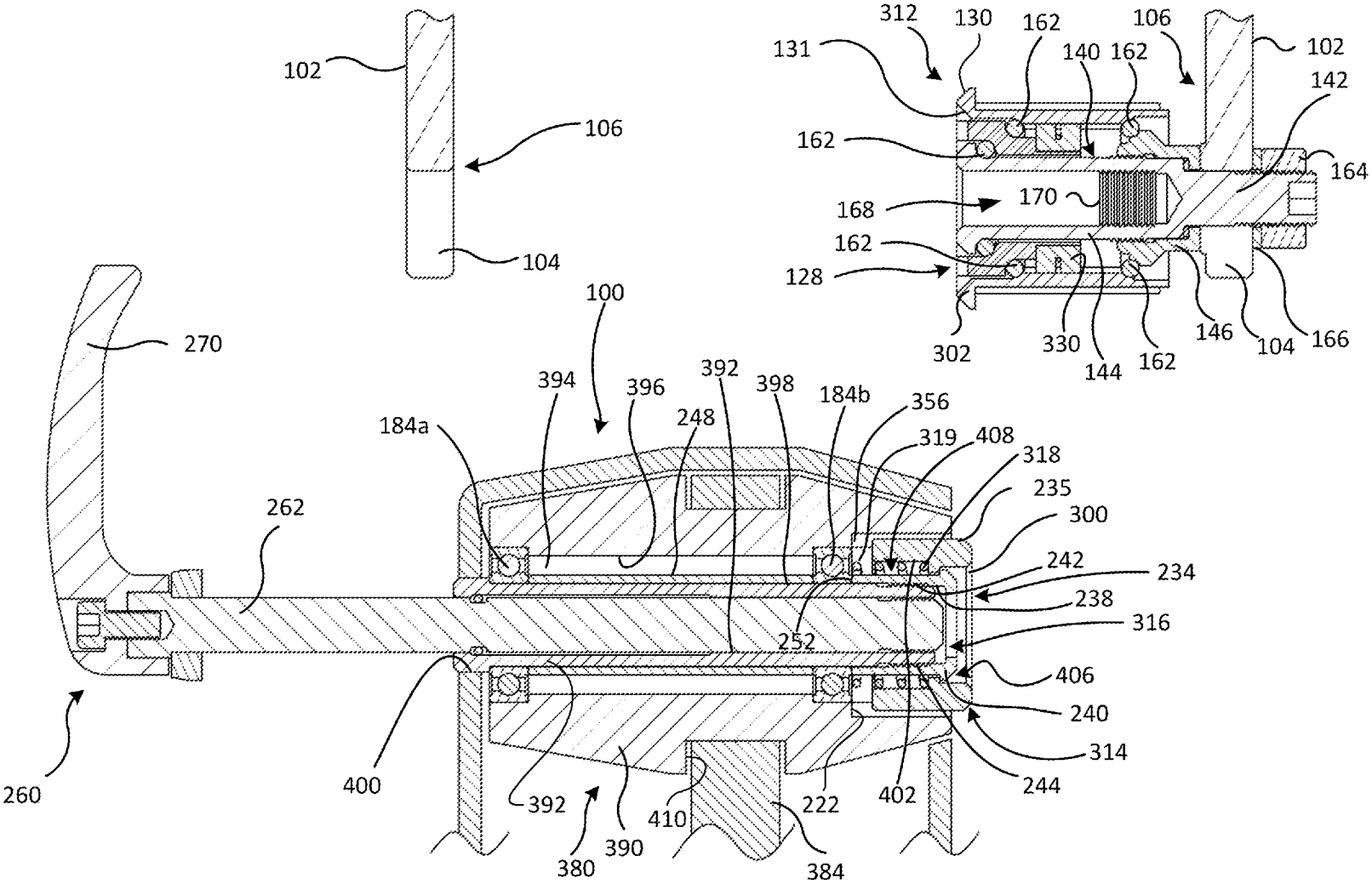
FIG. 12 shows a cross-section view taken along lines 12-12 of the bicycle trainer system of FIG. 2, but in a detached state where the frame portion of the bicycle is detached from the bicycle trainer.

Referring to FIGS. 11 and 12, the bicycle 50 is mounted to the trainer in the same manner as the rear wheel 58 is attached to the bicycle as described above. The trainer hub assembly 380 generally provides the same connection and function characteristics as the above described wheel hub assemblies 110 and 310. The bicycle frame 52 is identical to the above-described configuration with the rear wheel 58 removed. The driver mechanism 112, or 312, remains attached to the right frame dropout 106 and to the drive train 74 of the bicycle 50. The second example of the driver mechanism 312 is shown in FIG. 12 and will engage the trainer hub assembly 380 when the bicycle is mounted to the trainer 100.

Referring to FIG. 12, the trainer hub assembly 380 is a decoupling hub assembly but is different in structure to accommodate use within the trainer 100. The driver mechanism 312 and frame 52 of the bicycle 50 are shown in a detached state in FIG. 12. The trainer hub assembly 380 includes a hub body 390 that essentially replaces the above-described hub unit. The hub body 390 is mounted for rotation about a hub axis on a hub axle tube 392, which is nearly identical to the above-described hub axle tube 182. The hub body 390 has a generally cylindrical construction, although the body has a tapered diameter that is thinner near the ends and thicker near the middle of the body. The hub body 390 has a bore 394 through the body along the hub rotation axis.

The hub axle tube 392 is received within and along the bore 394 and also has an axial through bore 185. A plurality of bearings 184*a*, 184*b* may be disposed radially between an adjacent inner surface 396 of the hub body 390 and an outer surface 398 of the hub axle tube 392. The bearings 184*a*, 184*b* may be disposed in seats formed in the inner surface 396 of the bore 394 in the hub body 390. One end of the hub axle tube 392 protrudes through and beyond an open end of the hub body 390 and is received through a hole 400 in a side of the housing 348, is supported by the housing, and may be secured thereat in a suitable manner. The hub axle tube 392 is fixed to the housing 348 whereby the hub body 390 rotates about the hub rotation axis relative to the hub axle tube on the bearings 184*a*, 184*b*.

The other open end of the hub body 390 defines a cylindrical cavity 319, which has a diameter that is larger than the diameter of the adjacent portion of the bore 183. This diameter difference creates an internal shoulder 222 where the bore 183 of the hub body 390 transitions into the larger diameter cavity 319. The cavity 319 is open at the end of the hub body 390 and is also aligned with the hub rotation axis.

A torque coupler 314 is received in the cavity 319 and has a round or cylindrical shape. The torque coupler 314 also has a through hole 402 that is aligned with the hub rotation axis. An annular flange 404 extends radially inward within and divides the through hole between a cap recess 406 on the outward facing side of the torque coupler 314 and a spring recess 408 on the inward facing side of the torque coupler. The torque coupler 314 has an axial face 234 that faces outward from the cavity 319 and that surrounds the cap recess 406. The outer radial or peripheral edge 235 of the torque coupler 314 has a chamfered or tapered profile in the outward facing direction.

The torque coupler 314 is retained therein by a hub retaining cap 316. The hub retaining cap 316 has a through hole 238 that is also aligned with the hub rotation axis. One end of the through hole 238 is formed in a head 240 of the hub retaining cap 316 and is hex shaped to accept a hex wrench (not shown). The other end of the through hole 238 in the hub retaining cap 316 includes female threads 242 and has a diameter configured so that the hub retaining cap can engage male threads 244 on the outer surface of and near the outward end of the hub axle tube 392 so that the retaining cap screws onto the axle tube. The hub retaining cap 316 is sized to fit within the cap recess 406 of the torque coupler through hole 402 and the head 240 is sized to bear against the annular flange 404.

A spring 318 or biasing element is captured within the spring recess 408 of the torque coupler through hole 402. One end of the spring 408 bears against the other side of the annular flange 404 and the other end of the spring bears against the shoulder 222 within the cavity 319. A cylindrical spacer 248 is captured between the axially spaced apart bearings 184*a*, 184*b* and is received over the outer surface 398 of the hub axle tube 392. One of the bearings 184*a*, the left most bearing in FIG. 12, is borne against a step 250 on the outer surface 398 of the hub axle tube 392. When the hub retaining cap 316 is tightened using a hex wrench, its inward end 252 abuts against the other of the bearings 184*b*, the right most bearing in FIG. 12. The hub retaining cap 316 thus clamps the adjacent bearing 184*b*, the cylindrical spacer 248, and the remote bearing 184*a* against the step 250 within the bore 183 of the hub body 390. The hub body 390 is then freely rotatable relative to the hub axle tube 392. The step 250 in the hub axle tube 392 abuts against the outer race of the bearing 184*a* and the end 252 of the hub retainer cap 236 abuts against the outer race of the other bearing 184*b*. This arrangement prevents the hub body 390 from moving axially relative to the hub axle tube 392.

The circumferential outer surface of the torque coupler 314 has external splines (not shown) that are axially oriented. The splines engage with corresponding internal splines 256 on the inner facing surface of the cavity 319 in the hub body 390. Thus, the torque coupler 314 is axially movable within the cavity 319 but is rotationally fixed relative to the hub body 390 and thus will rotate in concert with the body. The spring 318 in this example is seated against the internal shoulder 222 of the cavity 319 and is borne against the annular flange 404, as noted above, and biases the torque coupler 314 outward relative to the cavity 319 and abuts the head 240 of the hub retaining cap 316, which acts as an outward direction travel stop for the torque coupler 314.

The trainer hub components also include a connecting device 260 that secures the trainer hub assembly 380 to the driver mechanism 312 on the bicycle. The connecting device is shown generically in FIGS. 10 and 11. The connecting device 260 is shown in FIG. 12 as being identical to the device earlier described with respect to FIGS. 3, 4A-4D, 8A, and 8B and operates in the same manner with respect to the trainer 100. The rear wheel 58 is removed from the bicycle frame 52 as depicted in FIG. 12 to prepare the bike for mounting on the trainer 100. The decoupling trainer hub assembly 380 and driver mechanism 312 are brought together in a transverse direction, aided by the tapered edge 235 on the torque coupler 314 and the tapered outer edge 326 on the coupling part 322 of the driver mechanism 312. The attachment or engagement and detachment or disengagement of the bicycle 50 relative to the trainer 100 is accomplished in the same manner as described above with reference to FIGS. 3, 4A-4D, 5, 8A, and 8B. Once the components are aligned, as depicted in FIG. 8B, the torque coupler 314 of the trainer hub assembly 380 and the coupling part 322 of the driver mechanism 312 engage one another as previously described in the earlier examples. The torque coupler 314 of the trainer hub assembly includes a plurality of teeth 300 on an axial face of the coupler. The teeth 300 engage the mating teeth on the 302 on the axial face of the coupling part 322.

Once engaged, the connecting device 260, which is received in the axial through bore 185 in the hub axle tube 392 can be tightened as previously described to secure the trainer hub assembly 380 to the driver mechanism 312. Once secured, any rotation of the drive train 74 on the bicycle 50 in the drive direction D will drive rotation of the torque coupler 314 of the trainer hub assembly 380. As shown in FIG. 12, the hub body can include a circumferential groove 410 around the body. The earlier mentioned drive belt 384 can be routed partly around the hub body 390 within the groove. Rotation of the hub body 390 will drive movement of the drive belt 384 to impart motion to the resistance generating mechanism 342.

The left dropout 106 of the frame 52 is supported on the connecting shaft 262 of the connecting device. The right dropout 106 of the frame 52 is supported by the bolt end 142 of the pivot rod 140 on the driver mechanism 312 in each of the foregoing examples. For the trainer 100, the upright 346 and the housing 348 of the stand 340 support the bicycle 50 through the left and right dropouts 106, instead of the rear wheel 58. The connecting device 260 for the trainer 100 can instead be a standard bolt and is thus depicted as a generic bolt in FIGS. 10 and 11. However, any design commonly referred to as a thru axle or shaft can be used, including a quick release lever, as is known in the art. If one or both of the dropouts 106 included a hole instead of a 104, the connecting device would need to be fully removed from the trainer 100 in order to mount or remove the bike from the trainer. With slots 104, the connecting device need only be loosened and axially displaced to allow the left dropout to be removed or detached.

In the disclosed example, the torque coupler 314 transmits torque from the drive teeth 302 of the driver mechanism 312 into the inner resistance generating mechanism 342 of the trainer 100. The hub body 390 rotates with the torque coupler 314 in a 1:1 relationship, as the two components are rotationally fixed. The hub body 390 rotates, which in turn drives movement of the drive belt 384. The drive belt 384 may be entirely covered by the housing 348, as in this example, but could instead be partially or completely external to the housing. The drive belt 384 is driven by the hub body 390 pulley and in turn drives the flywheel 350 through the flywheel shaft 378. The relative size of the hub body 390 and the flywheel shaft 378 can be such that the flywheel 350 rotates at a faster RPM than the hub body 390.

A strain gage of a load cell 412, or other load measuring device, may be located on the flywheel shaft 378 or may be adjacent the shaft or the drive belt 384. In any event, the load cell or strain gage 412 can be positioned on the stand 340 so as to measure either the strain in one of the loaded parts or to sense some other characteristic that is indicative of the load generated by the rider as a part of the power subsystem 360. The measured data may be used to generate or derive a value of power input for informational purposes, such as to display or save in an external storage for the rider, or the measured data may be used as an input for the processor subsystem 366 to control the resistance applied to the flywheel 350. Additionally, the trainer 100 may include a RPM sensor 364 that is either within the housing as shown in FIG. 11, or that is separately attached to the bicycle 50, remote from the trainer 100. The RPM sensor 364 may measure the RPM of the torque coupler 314, which is the same RPM as the driver mechanism 312, which is the same RPM as the cassette 90 of the drive train 74. If the gear ratio is known, the cadence, also known as crank RPM, can be calculated or derived by the processor subsystem 366. In either case, knowing the input load and the RPM allows the processor subsystem 366 to calculate the power input from the rider. Both RPM measurement and load cell measurement are not necessary for the basic operation of the disclosed trainer 100. However, combined with aspects of the disclosed trainer 100, an unexpected result is achieved, which is fully electronic controllable data generating bike trainer 100 that does not require additional calibration for use with different bicycles.

As disclosed herein, the trainer hub assembly 380, as well as the rear wheel hub assemblies 110, 310, and driver mechanisms 112, 312, achieve a much improved, simpler, and easier to use bicycle trainer system. The drive train 74, including the chain 88, cassette 90, cassette driver mechanism 112, 312, crank assembly 82, and chainrings 80 remain fixed to the bicycle 50. The rider never has to mess with the chain 88 in switching from the rear wheel 58 to the trainer 100. To attach the bicycle 50 to the trainer 100, the connecting device 260 is unscrewed and moved axially out of engagement with the driver mechanism 112, 312. The rear wheel 58 is then easily removed, leaving the cassette 90 and cassette driver mechanism 112, 312 decoupled from the rear wheel. The bicycle 50 is placed on the trainer stand 340, and the torque coupler 314 of the trainer hub assembly 380 is aligned and engaged with the driver mechanism. The teeth 300 on the torque coupler 314 and the mating teeth on the driver mechanism 112, 312 axially overlap with one another, which allows the torque to be transmitted from the drive train 74 to the trainer hub assembly 380.

In order to permit assembly of the bicycle 50 to the trainer 100, and to create achieve this axial overlap, the torque coupler 314 is preloaded by the spring 318, allowing the teeth 300 to move axially to align the parts prior to teeth engagement. Once the driver mechanism and the torque coupler are axially aligned and engaged, the torque coupler is then returned by the force of the spring 318 to its original axial position, while generating the required amount of axial overlap to transmit torque. While the disclosed examples are shown with the torque coupler being preloaded by the spring and axially displaceable, the coupling part of the driver mechanism could instead be spring biased and axially displaceable. Additionally, it is possible that another component of the trainer may be axially displaceable to achieve a similar effect. For example, on the non-drive side of the trainer, the hub body or the hub axle tube may be preloaded and axially displaceable for assembly of the bicycle to the trainer. Further, the bicycle frame 52 in the area of the dropouts 106 may be axially displaceable relative to each other such that the frame elements can spread open during assembly with the trainer and return toward each other once the driver mechanism and the torque coupler are aligned. Certainly, many other modifications to the components described herein can be implemented without departing from the intent of the disclosure.

Although certain wheel hub assemblies, trainer hub assemblies, bicycle trainers, and bicycle trainer systems have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A bicycle trainer comprising:

a stand;

a resistance generating mechanism carried by the stand; and a decoupling hub assembly carried on the stand and including a torque coupler, the torque coupler operably connected to the resistance generating mechanism, wherein the torque coupler has a coupling portion extending from an exposed axial end face of the torque coupler, the coupling portion configured and arranged relative to the stand to contact and engage a coupling part of a driver mechanism on a bicycle.

2. The bicycle trainer of claim 1, wherein the stand includes a base and an upright extending up from the base, and wherein the coupling portion of the torque coupler is exposed to an exterior of the upright.

3. The bicycle trainer of claim 1, wherein the stand includes a housing, and wherein the coupling portion is exposed to an exterior of the housing.

4. The bicycle trainer of claim 1, wherein the exposed axial face includes a plurality of teeth.

5. The bicycle trainer of claim 4, wherein each tooth of the plurality of teeth is a shallow angled surface on a back side of the tooth.

6. The bicycle trainer of claim 1, wherein the coupling portion of the torque coupler is biased in a direction toward the exterior of the stand.

7. The bicycle trainer of claim 1, wherein the coupling portion of the torque coupler is resiliently biased by a compression spring toward the exterior of the stand.

8. The bicycle trainer of claim 1, wherein the decoupling hub assembly includes a hub body connected to the torque coupler and rotatable about a hub rotation axis, and wherein a groove is formed circumferentially around an exterior of the hub body.

9. The bicycle trainer of claim 8, wherein the resistance generating mechanism includes a drive belt that is routed at least partially around the hub body within the groove.

10. The bicycle trainer of claim 8, wherein the hub rotation axis is defined by a hub axle tube disposed within a housing of the stand.

11. The bicycle trainer of claim 10, wherein the decoupling hub assembly includes one or more bearings disposed radially between the hub body and the hub axle tube.

12. The bicycle trainer of claim 1, further comprising a connecting device with a connecting shaft extendable through the decoupling hub assembly, the connecting shaft having a proximal end, a free end, and a length such that the free end can extend outward beyond the coupling portion of the torque coupler at the exterior of the stand.

13. The bicycle trainer of claim 1, wherein the resistance generating assembly includes a drive belt.

14. The bicycle trainer of claim 1, wherein the resistance generating assembly includes a torque or load measurement element.

15. The bicycle trainer of claim 1, wherein the resistance generating assembly includes a flywheel.

16. The bicycle trainer of claim 1, further comprising:

a sensor for sensing a revolutions per minute (RPM) of the torque coupler or a portion of the resistance generating assembly.

17. The bicycle trainer of claim 1, further comprising:

a load subsystem for imparting a load to the resistance generating mechanism;

a power subsystem for deriving a power input by a rider to the bicycle trainer during use;

a speed subsystem for deriving a speed characteristic of the bicycle trainer during use; and a processor subsystem including a processor configured to communicate with the load, power, and speed subsystems and to control aspects of same.

18. A decoupling hub assembly of a bicycle trainer, the decoupling hub assembly comprising:

a hub axle tube having a lengthwise bore therethrough and defining a hub rotation axis;

a hub body received over the hub axle tube and rotatable about the hub rotation axis, the hub body having a groove formed circumferentially around an exterior of the hub body;

a torque coupler rotatably fixed relative to the hub body and seated in a cavity concentric with the hub rotation axis in one end of the hub body, the torque coupler having a through bore and a coupling portion extending from an exposed axial end face;

a connecting device with a connecting shaft extending through the lengthwise bore of the hub axle tube and the through bore of the torque coupler, the connecting shaft having a proximal end with a lever, a free end with male mechanical threads, and a length such that the free end can extend outward beyond the coupling portion of the torque coupler; and a plurality of teeth extending from the exposed axial end face of the coupling portion, the plurality of teeth configured to engage mating teeth on a coupling part of a driver mechanism of a bicycle drive train, wherein the coupling portion of the torque coupler is resiliently biased in a direction outward from the cavity.

19. A bicycle trainer system comprising:

a bicycle trainer having a stand, a resistance generating mechanism carried at least in part by the stand, and a decoupling hub assembly carried by the stand, the decoupling hub assembly including a torque coupler operably coupled to the resistance generating assembly; and a bicycle having a drive train, a frame, and a driver mechanism carried near a dropout of the frame, the drive train including a plurality of sprockets, the drive train rotatably carried on the frame and arranged to drive rotation of the driver mechanism, wherein the torque coupler has a coupling portion exposed to an exterior of the bicycle trainer and the driver mechanism has a coupling part, wherein, when a rear wheel of the bicycle is detached from the dropout of the frame and the drive train, the stand is configured to support the dropout of the frame, and wherein the coupling portion of the torque coupler is configured to detachably engage the coupling part of the driver mechanism to transmit torque in a torque transmitting or drive direction from the drive train to the resistance generating mechanism.

* * * * *